US010801495B2

(12) United States Patent
Perevozchikov et al.

(10) Patent No.: US 10,801,495 B2
(45) Date of Patent: Oct. 13, 2020

(54) OIL FLOW THROUGH THE BEARINGS OF A SCROLL COMPRESSOR

(71) Applicant: Emerson Climate Technologies, Inc., Sidney, OH (US)

(72) Inventors: Michael M. Perevozchikov, Tipp City, OH (US); Kevin J. Gehret, Fort Loramie, OH (US); Kirill M. Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 261 days.

(21) Appl. No.: 15/692,844

(22) Filed: Aug. 31, 2017

(65) Prior Publication Data

US 2018/0066656 A1 Mar. 8, 2018

Related U.S. Application Data

(63) Continuation-in-part of application No. 15/682,599, filed on Aug. 22, 2017.

(Continued)

(51) Int. Cl.
*F04C 18/02* (2006.01)
*F04C 23/00* (2006.01)

(Continued)

(52) U.S. Cl.
CPC ..... *F04C 18/0215* (2013.01); *F04C 18/0253* (2013.01); *F04C 18/3568* (2013.01);

(Continued)

(58) Field of Classification Search
CPC ..... F04C 18/0223; F04C 18/0215; F04C 23/008; F01C 1/0246; F01C 1/0215

(Continued)

(56) References Cited

U.S. PATENT DOCUMENTS 4,058,988 A 11/1977 Shaw
4,216,661 A 8/1980 Tojo et al.

(Continued)

FOREIGN PATENT DOCUMENTS

CN 1137614 A 12/1996
CN 1158944 A 9/1997

(Continued)

OTHER PUBLICATIONS

International Search Report regarding Application No. PCT/US2011/025921, dated Oct. 7, 2011.

(Continued)

*Primary Examiner* — Deming Wan
(74) *Attorney, Agent, or Firm* — Harness, Dickey & Pierce, P.L.C.

(57) ABSTRACT

A compressor according to the principles of the present disclosure includes a shell, a compression mechanism, a driveshaft, a drive bearing cavity, and a drive bearing. The compression mechanism is disposed within the shell and includes an orbiting scroll member and a non-orbiting scroll member. The orbiting scroll member includes a baseplate and a tubular portion extending axially from the baseplate. The driveshaft is drivingly engaged with the orbiting scroll member. The drive bearing cavity is disposed between an outer radial surface of the driveshaft and an inner radial surface of the tubular portion of the orbiting scroll member. The baseplate of the orbiting scroll member defines a first discharge passage in fluid communication with the drive bearing cavity. The drive bearing is disposed in the drive bearing cavity and is disposed about the driveshaft adjacent to the first end of the driveshaft.

13 Claims, 6 Drawing Sheets

Related U.S. Application Data

(60) Provisional application No. 62/384,976, filed on Sep. 8, 2016, provisional application No. 62/455,679, filed on Feb. 7, 2017.

(51) Int. Cl.

| | |
|---|---|
| ***F01C 1/02*** | (2006.01) |
| ***F04C 18/356*** | (2006.01) |
| ***F04C 29/00*** | (2006.01) |
| ***F04C 29/02*** | (2006.01) |
| *F01C 17/06* | (2006.01) |
| *F25B 31/02* | (2006.01) |

(52) U.S. Cl.
CPC ..... *F04C 23/008* (2013.01); *F04C 29/0071* (2013.01); *F04C 29/028* (2013.01); *F01C 17/066* (2013.01); *F04C 2240/56* (2013.01); *F25B 31/026* (2013.01)

(58) Field of Classification Search
USPC ..... 418/55.2, 55.6
See application file for complete search history.

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,466,784 A 8/1984 Hiraga
4,475,360 A 10/1984 Suefuji et al.
4,475,875 A 10/1984 Sugimoto et al.
4,497,615 A 2/1985 Griffith
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,898,520 A 2/1990 Nieter et al.
4,927,339 A 5/1990 Riffe et al.
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,356,271 A 10/1994 Miura et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,511,959 A * 4/1996 Tojo ..... C04B 35/591 384/907.1
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,607,288 A 3/1997 Wallis et al.
5,611,674 A 3/1997 Bass et al.
5,613,841 A 3/1997 Bass et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,775,893 A 7/1998 Takao et al.
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,030,192 A 2/2000 Hill et al.
6,047,557 A 4/2000 Pham et al.
6,068,459 A 5/2000 Clarke et al.
6,086,335 A 7/2000 Bass et al.
6,093,005 A 7/2000 Nakamura
6,095,765 A 8/2000 Khalifa
6,102,671 A 8/2000 Yamamoto et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,257,840 B1 7/2001 Ignatiev et al.
6,264,444 B1 7/2001 Nakane et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 9/2001 Bass
6,293,776 B1 9/2001 Hahn et al.
6,309,194 B1 10/2001 Fraser et al.
6,322,340 B1 11/2001 Itoh et al.
6,338,912 B1 1/2002 Ban et al.
6,350,111 B1 2/2002 Perevozchikov et al.

(56) References Cited

U.S. PATENT DOCUMENTS 6,361,890 B1 3/2002 Ban et al.
6,379,123 B1 4/2002 Makino et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,514,060 B1 * 2/2003 Ishiguro ..... F04C 18/0215 418/188
6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,679,683 B2 1/2004 Seibel et al.
6,705,848 B2 3/2004 Scancarello
6,715,999 B2 4/2004 Ancel et al.
6,746,223 B2 6/2004 Manole
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,207,787 B2 4/2007 Liang et al.
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,510,382 B2 3/2009 Jeong
7,547,202 B2 6/2009 Knapke
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
8,025,492 B2 9/2011 Seibel et al.
8,303,278 B2 11/2012 Roof et al.
8,303,279 B2 11/2012 Hahn
8,308,448 B2 11/2012 Fields et al.
8,328,531 B2 12/2012 Milliff et al.
8,393,882 B2 3/2013 Ignatiev et al.
8,506,271 B2 8/2013 Seibel et al.
8,517,703 B2 8/2013 Doepker
8,585,382 B2 11/2013 Akei et al.
8,616,014 B2 12/2013 Stover et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,127,677 B2 9/2015 Doepker
9,145,891 B2 9/2015 Kim et al.
9,249,802 B2 2/2016 Doepker et al.
9,303,642 B2 4/2016 Akei et al.
9,435,340 B2 9/2016 Doepker et al.
9,494,157 B2 11/2016 Doepker
9,605,677 B2 3/2017 Heidecker et al.
9,624,928 B2 4/2017 Yamazaki et al.
9,651,043 B2 5/2017 Stover et al.
9,777,730 B2 10/2017 Doepker et al.
9,790,940 B2 10/2017 Doepker et al.
9,879,674 B2 1/2018 Akei et al.
9,989,057 B2 6/2018 Lochner et al.
10,066,622 B2 9/2018 Pax et al.
10,087,936 B2 10/2018 Pax et al.
10,094,380 B2 10/2018 Doepker et al.
2001/0010800 A1 8/2001 Kohsokabe et al.
2002/0039540 A1 4/2002 Kuroki et al.
2003/0044296 A1 3/2003 Chen
2003/0044297 A1 3/2003 Gennami et al.
2003/0186060 A1 10/2003 Rao
2003/0228235 A1 12/2003 Sowa et al.
2004/0126259 A1 7/2004 Choi et al.
2004/0136854 A1 7/2004 Kimura et al.
2004/0146419 A1 7/2004 Kawaguchi et al.
2004/0170509 A1 9/2004 Wehrenberg et al.
2004/0184932 A1 9/2004 Lifson
2004/0197204 A1 10/2004 Yamanouchi et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0140232 A1 6/2005 Lee et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2007/0036661 A1 2/2007 Stover
2007/0110604 A1 5/2007 Peyton
2007/0130973 A1 6/2007 Lifson et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0196445 A1 8/2008 Lifson et al.
2008/0223057 A1 9/2008 Lifson et al.
2008/0226483 A1 9/2008 Iwanami et al.
2008/0305270 A1 12/2008 Uhlianuk et al.
2009/0035167 A1 2/2009 Sun
2009/0068048 A1 3/2009 Stover et al.
2009/0071183 A1 3/2009 Stover et al.
2009/0185935 A1 7/2009 Seibel et al.
2009/0191080 A1 7/2009 Ignatiev et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.

(56) References Cited

U.S. PATENT DOCUMENTS

| | | | | |
|---|---|---|---|---|
| 2010/0212311 | A1 | 8/2010 | McQuary et al. | |
| 2010/0212352 | A1 | 8/2010 | Kim et al. | |
| 2010/0254841 | A1 | 10/2010 | Akei et al. | |
| 2010/0300659 | A1 | 12/2010 | Stover et al. | |
| 2010/0303659 | A1 | 12/2010 | Stover et al. | |
| 2011/0135509 | A1 | 6/2011 | Fields et al. | |
| 2011/0206548 | A1 | 8/2011 | Doepker | |
| 2011/0243777 | A1* | 10/2011 | Ito | F04C 18/0215 418/55.2 |
| 2011/0250085 | A1 | 10/2011 | Stover et al. | |
| 2011/0293456 | A1 | 12/2011 | Seibel et al. | |
| 2012/0009076 | A1 | 1/2012 | Kim et al. | |
| 2012/0107163 | A1 | 5/2012 | Monnier et al. | |
| 2012/0183422 | A1 | 7/2012 | Bahmata | |
| 2012/0195781 | A1* | 8/2012 | Stover | F04C 18/0215 418/55.2 |
| 2013/0078128 | A1 | 3/2013 | Akei | |
| 2013/0089448 | A1 | 4/2013 | Ginies et al. | |
| 2013/0094987 | A1 | 4/2013 | Yamashita et al. | |
| 2013/0121857 | A1 | 5/2013 | Liang et al. | |
| 2013/0302198 | A1 | 11/2013 | Ginies et al. | |
| 2013/0309118 | A1 | 11/2013 | Ginies et al. | |
| 2013/0315768 | A1 | 11/2013 | Le Coat et al. | |
| 2014/0023540 | A1 | 1/2014 | Heidecker et al. | |
| 2014/0024563 | A1 | 1/2014 | Heidecker et al. | |
| 2014/0037486 | A1 | 2/2014 | Stover et al. | |
| 2014/0134030 | A1 | 5/2014 | Stover et al. | |
| 2014/0134031 | A1 | 5/2014 | Doepker et al. | |
| 2014/0147294 | A1 | 5/2014 | Fargo et al. | |
| 2014/0154121 | A1 | 6/2014 | Doepker | |
| 2014/0154124 | A1 | 6/2014 | Doepker et al. | |
| 2015/0037184 | A1 | 2/2015 | Rood et al. | |
| 2015/0086404 | A1 | 3/2015 | Kiem et al. | |
| 2015/0192121 | A1 | 7/2015 | Sung et al. | |
| 2015/0330386 | A1 | 11/2015 | Doepker | |
| 2015/0345493 | A1 | 12/2015 | Lochner et al. | |
| 2015/0354719 | A1 | 12/2015 | van Beek et al. | |
| 2016/0025093 | A1 | 1/2016 | Doepker | |
| 2016/0025094 | A1 | 1/2016 | Ignatiev et al. | |
| 2016/0047380 | A1 | 2/2016 | Kim et al. | |
| 2016/0053759 | A1 | 2/2016 | Choi et al. | |
| 2016/0076543 | A1 | 3/2016 | Akei et al. | |
| 2016/0115954 | A1 | 4/2016 | Doepker et al. | |
| 2016/0138879 | A1 | 5/2016 | Matsukado et al. | |
| 2016/0201673 | A1 | 7/2016 | Perevozchikov et al. | |
| 2016/0208803 | A1 | 7/2016 | Uekawa et al. | |
| 2017/0002817 | A1 | 1/2017 | Stover | |
| 2017/0002818 | A1 | 1/2017 | Stover | |
| 2017/0030354 | A1 | 2/2017 | Stover | |
| 2017/0241417 | A1 | 8/2017 | Jin et al. | |
| 2017/0268510 | A1 | 9/2017 | Stover et al. | |
| 2017/0306960 | A1 | 10/2017 | Pax et al. | |
| 2017/0314558 | A1 | 11/2017 | Pax et al. | |
| 2017/0342978 | A1 | 11/2017 | Doepker | |
| 2017/0342983 | A1 | 11/2017 | Jin et al. | |
| 2017/0342984 | A1 | 11/2017 | Jin et al. | |
| 2018/0023570 | A1* | 1/2018 | Huang | F01C 17/066 418/55.4 |
| 2018/0038369 | A1 | 2/2018 | Doepker et al. | |
| 2018/0038370 | A1 | 2/2018 | Doepker et al. | |
| 2018/0066657 | A1 | 3/2018 | Perevozchikov et al. | |
| 2018/0149155 | A1 | 5/2018 | Akei et al. | |
| 2018/0223823 | A1 | 8/2018 | Ignatiev et al. | |
| 2019/0040861 | A1 | 2/2019 | Doepker et al. | |
| 2019/0101120 | A1 | 4/2019 | Perevozchikov et al. | |
| 2019/0186491 | A1 | 6/2019 | Perevozchikov et al. | |
| 2019/0203709 | A1 | 7/2019 | Her et al. | |
| 2019/0353164 | A1 | 11/2019 | Berning et al. | |

FOREIGN PATENT DOCUMENTS

| | | | |
|---|---|---|---|
| CN | 1158945 | A | 9/1997 |
| CN | 1177681 | A | 4/1998 |
| CN | 1177683 | A | 4/1998 |
| CN | 1259625 | A | 7/2000 |
| CN | 1286358 | A | 3/2001 |
| CN | 1289011 | A | 3/2001 |
| CN | 1339087 | A | 3/2002 |
| CN | 1349053 | A | 5/2002 |
| CN | 1382912 | A | 12/2002 |
| CN | 1407233 | A | 4/2003 |
| CN | 1517553 | A | 8/2004 |
| CN | 1680720 | A | 10/2005 |
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 209621603 | U | 11/2019 |
| CN | 209654225 | U | 11/2019 |
| DE | 3917656 | C2 | 11/1995 |
| DE | 102011001394 | A1 | 9/2012 |
| EP | 0747598 | A2 | 12/1996 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | 03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H7026618 | B2 | 3/1995 |
| JP | H07293456 | A | 11/1995 |
| JP | H08247053 | A | 9/1996 |
| JP | H8320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |

(56) References Cited

FOREIGN PATENT DOCUMENTS

| | | | |
|---|---|---|---|
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2013104305 | A | 5/2013 |
| JP | 2013167215 | A | 8/2013 |
| KR | 1019870000015 | | 5/1985 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 20120008045 | A | 1/2012 |
| KR | 101192642 | B1 | 10/2012 |
| KR | 20120115581 | A | 10/2012 |
| KR | 20130094646 | A | 8/2013 |
| WO | WO-9515025 | A1 | 6/1995 |
| WO | WO-0073659 | A1 | 12/2000 |
| WO | WO-2007046810 | A2 | 4/2007 |
| WO | WO-2008060525 | A1 | 5/2008 |
| WO | WO-2009017741 | A1 | 2/2009 |
| WO | WO-2009155099 | A2 | 12/2009 |
| WO | WO-2010118140 | A2 | 10/2010 |
| WO | WO-2011106422 | A2 | 9/2011 |
| WO | WO-2012114455 | A1 | 8/2012 |
| WO | WO-2017071641 | A1 | 5/2017 |

OTHER PUBLICATIONS

Written Opinion of the International Search Authority regarding Application No. PCT/US2011/025921, dated Oct. 7, 2011.
Written Opinion of the International Searching Authority regarding Application No. PCT/US2010/030248, dated Nov. 26, 2010.
International Search Report regarding Application No. PCT/US2010/030248, dated Nov. 26, 2010.
U.S. Office Action regarding U.S. Appl. No. 13/181,065, dated Nov. 9, 2012.
U.S. Office Action regarding U.S. Appl. No. 11/645,288, dated Nov. 30, 2009.
Extended European Search Report regarding Application No. EP07254962, dated Mar. 12, 2008.
First China Office Action regarding Application No. 200710160038.5, dated Jul. 8, 2010. Translation provided by Unitalen Attorneys at Law.
China Office Action regarding Application No. 200710160038.5, dated Jan. 31, 2012. Translation provided by Unitalen Attorneys at Law.
China Office Action regarding Application No. 201080020243.1, dated Nov. 5, 2013. Translation provided by Unitalen Attorneys at Law.
International Search Report regarding Application No. PCT/US2013/051678, dated Oct. 21, 2013.
Written Opinion of the International Searching Authority regarding Application No. PCT/US2013/051678, dated Oct. 21, 2013.
International Search Report regarding Application No. PCT/US2013/069462, dated Feb. 21, 2014.
Written Opinion of the International Searching Authority regarding Application No. PCT/US2013/069462, dated Feb. 21, 2014.
International Search Report regarding Application No. PCT/US2013/070981, dated Mar. 4, 2014.
Written Opinion of the International Searching Authority regarding Application No. PCT/US2013/070981, dated Mar. 4, 2014.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
Second Office Action regarding China Application No. 201180010366.1, dated Dec. 31, 2014. Translation provided by Unitalen Attorneys at Law.
Office Action regarding U.S. Appl. No. 14/081,390, dated Mar. 27, 2015.
Search Report regarding European Patent Application No. 10762374.6-1608 / 2417356 PCT/US2010030248, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Interview Summary regarding U.S. Appl. No. 14/060,240, dated Dec. 1, 2015.
Office Action regarding Chinese Patent Application No. 201410461048.2, dated Nov. 30, 2015. Translation provided by Unitalen Attorneys at Law.
Office Action regarding U.S. Appl. No. 14/073,293, dated Jan. 29, 2016.
Restriction Requirement regarding U.S. Appl. No. 14/060,102, dated Mar. 16, 2016.
Office Action regarding Chinese Patent Application No. 201410460792.0, dated Feb. 25, 2016. Translation provided by Unitalen Attorneys at Law.
Advisory Action regarding U.S. Appl. No. 14/073,293, dated Apr. 18, 2016.
First Office Action regarding Chinese Application No. 201380059666.8, dated Apr. 5, 2016. Translation provided by Unitalen Attorneys at Law.
First Office Action regarding Chinese Application No. 201380062614.6, dated Apr. 5, 2016. Translation provided by Unitalen Attorneys at Law.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.

(56) References Cited

OTHER PUBLICATIONS

Office Action regarding Chinese Patent Application No. 201410460792.0, dated Oct. 21, 2016. Translation provided by Unitalen Attorneys at Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201410460792.0, dated Nov. 1, 2017. Translation provided by Unitalen Attorneys at Law.
Office Action regarding Chinese Patent Application No. 201610158216.X, dated Oct. 30, 2017. Translation provided by Unitalen Attorneys at Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/651,471 dated Feb. 23, 2018.
Office Action regarding U.S. Appl. No. 15/646,654, dated Feb. 9, 2018.
Office Action regarding Indian Patent Application No. 1907/MUMNP/2012, dated Feb. 26, 2018.
Election Requirement regarding U.S. Appl. No. 15/784,458, dated Apr. 5, 2018.
Election Requirement regarding U.S. Appl. No. 15/186,092, dated Apr. 3, 2018.
Office Action regarding U.S. Appl. No. 15/186,151, dated May 3, 2018.
Election/Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610930347.5, dated May 14, 2018. Translation provided by Unitalen Attorneys at Law.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding Korean Patent Application No. 10-2016-7034539, dated Apr. 11, 2018. Translation provided by Y.S. Chang & Associates.
Office Action regarding Chinese Patent Application No. 201610158216.X, dated Jun. 13, 2018. Translation provided by Unitalen Attorneys at Law.
Office Action regarding U.S. Appl. No. 15/784,540, dated Jul. 17, 2018.
Office Action regarding European Patent Application No. 13859308.2, dated Jun. 22, 2018.
Office Action regarding U.S. Appl. No. 15/784,458, dated Jul. 19, 2018.
Election/Restriction Requirement regarding U.S. Appl. No. 15/587,735, dated Jul. 23, 2018.
Applicant-Initiated Interview Summary regarding U.S. Appl. No. 15/186,092, dated Aug. 14, 2018.
Office Action regarding U.S. Appl. No. 15/187,225, dated Aug. 27, 2018.
Office Action regarding Indian Patent Application No. 1307/MUMNP/2015, dated Sep. 12, 2018.
Office Action regarding Chinese Patent Application No. 201610499158.7, dated Aug. 1, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding U.S. Appl. No. 15/587,735, dated Oct. 9, 2018.
Office Action regarding Chinese Patent Application No. 201710795228.8, dated Sep. 5, 2018. Translation provided by Unitalen Attorneys at Law.
Office Action regarding Chinese Patent Application No. 201580029636.1, dated Oct. 8, 2018. Translation provided by Unitalen Attorneys at Law.
Office Action regarding U.S. Appl. No. 15/186,151, dated Nov. 1, 2018.
Luckevich, Mark, "MEMS microvalves: the new valve world." Valve World, May 2007, pp. 79-83.
Office Action regarding Chinese Patent Application No. 201580041209.5, dated Jan. 17, 2018. Translation provided by Unitalen Attorneys at Law.
Office Action regarding Indian Patent Application No. 1306/MUMNP/2015, dated Dec. 31, 2018.
Notice of Allowance regarding U.S. Appl. No. 15/187,225 dated Jan. 3, 2019.
Notice of Allowance regarding U.S. Appl. No. 15/186,092, dated Dec. 20, 2018.
Notice of Allowance regarding U.S. Appl. No. 15/784,458, dated Feb. 7, 2019.
Notice of Allowance regarding U.S. Appl. No. 15/784,540, dated Feb. 7, 2019.
Office Action regarding Chinese Patent Application No. 201610516097.0, dated Jun. 27, 2017. Translation provided by Unitalen Attorneys at Law.
Search Report regarding European Patent Application No. 18198310.7, dated Feb. 27, 2019.
Office Action regarding Chinese Patent Application No. 201610499158.7, dated Feb. 1, 2019. Translation provided by Unitalen Attorneys at Law.
Office Action regarding Chinese Patent Application No. 201180010366.1, dated Jun. 4, 2014. Translation provided by Unitalen Attorneys at Law.

(56) References Cited

OTHER PUBLICATIONS

Notice of Allowance regarding U.S. Appl. No. 15/186,151, dated Mar. 19, 2019.
Office Action regarding Chinese Patent Application No. 201710795228.8, dated Apr. 29, 2019. Translation provided by Unitalen Attorneys at Law.
Office Action regarding U.S. Appl. No. 15/587,735, dated May 17, 2019.
Notice of Allowance regarding U.S. Appl. No. 15/187,225 dated May 2, 2019.
Notice of Allowance regarding U.S. Appl. No. 15/186,092 dated Apr. 19, 2019.
U.S. Appl. No. 15/831,423, filed Dec. 5, 2017, Kirill M. Ignatiev et al.
Non-Final Office Action for U.S. Appl. No. 11/522,250, dated Aug. 1, 2007.
Notification of the First Office Action received from the Chinese Patent Office dated Mar. 6, 2009 regarding Application No. 200710153687.2, translated by CCPIT Patent and Trademark Law Office.
Non-Final Office Action for U.S. Appl. No. 12/103,265, dated May 27, 2009.
Non-Final Office Action for U.S. Appl. No. 12/103,265, dated Dec. 17, 2009.
Notice of Grounds for Rejection regarding Korean Patent Application No. 10-2007-0093478 dated Feb. 25, 2010. Translation provided by Y.S. Chang & Associates.
Final Office Action for U.S. Appl. No. 12/103,265, dated Jun. 15, 2010.
Final Preliminary Notice of Grounds for Rejection regarding Korean Patent Application No. 10-2007-0093478, dated Aug. 31, 2010. Translation provided by Y.S. Chang & Associates.
Advisory Action for U.S. Appl. No. 12/103,265, dated Sep. 17, 2010.
First Office Action regarding Chinese Patent Application No. 201010224582.3, dated Apr. 17, 2012. English translation provided by Unitalen Attorneys at Law.
First Examination Report regarding India-Patent Application No. 1071/KOL/2007, dated Apr. 27, 2012.
Non-Final Office Action for U.S. Appl. No. 13/0365,529, dated Aug. 22, 2012.
International Search Report regarding International Application No. PCT/US2017/050525, dated Dec. 28, 2017.
Written Opinion of the International Searching Authority regarding International Application No. PCT/US2017/050525, dated Dec. 28, 2017.
Non-Final Office Action for U.S. Appl. No. 14/809,786, dated Jan. 11, 2018.
U.S. Appl. No. 15/682,599, filed Aug. 22, 2017, Perevozchikov et al.
International Search Report regarding International Application No. PCT/US2015/042479, dated Oct. 23, 2015.
Written Opinion of the International Searching Authority regarding International Application No. PCT/US2015/042479, dated Oct. 23, 2015.
Restriction Requirement regarding U.S. Appl. No. 14/809,786, dated Aug. 16, 2017.
Office Action regarding European Patent Application No. 11747996.4, dated Jun. 26, 2019.
Office Action regarding Chinese Patent Application No. 201811011292.3, dated Jun. 21, 2019. Translation provided by Unitalen Attorneys at Law.
Notice of Allowance regarding U.S. Appl. No. 15/186,151, dated Jul. 25, 2019.
Notice of Allowance regarding U.S. Appl. No. 15/587,735, dated Aug. 23, 2019.
Office Action regarding Chinese Patent Application No. 201610499158.7, dated Aug. 1, 2019. Translation provided by Unitalen Attorneys at Law.
Office Action regarding Chinese Patent Application No. 201780055443.2, dated Sep. 2, 2019. Translation provided by Unitalen Attorneys at Law.
Restriction Requirement regarding U.S. Appl. No. 15/682,599, dated Aug. 14, 2019.
Office Action regarding Chinese Patent Application No. 201811168307.7, dated Aug. 12, 2019. Translation provided by Unitalen Attorneys at Law.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding European Patent Application No. 11747996.4, dated Nov. 5, 2019.
Notice of Allowance regarding U.S. Appl. No. 15/186,151 dated Nov. 14, 2019.
Office Action regarding Chinese Patent Application No. 201710795228.8, dated Oct. 28, 2019. Translation provided by Unitalen Attorneys at Law.
Office Action regarding U.S. Appl. No. 15/682,599, dated Jan. 24, 2020.
Office Action regarding U.S. Appl. No. 15/881,016, dated Jan. 23, 2020.
Office Action regarding U.S. Appl. No. 15/831,423, dated Jan. 31, 2020.
Office Action regarding Chinese Patent Application No. 201811480347.5, dated Jan. 10, 2020. Translation provided by Unitalen Attorneys at Law.
Office Action regarding European Patent Application No. 11747996.4, dated Jan. 14, 2020.
Office Action regarding Indian Patent Application No. 2043/MUMNP/2011, dated Nov. 27, 2019.
Office Action regarding Chinese Patent Application No. 201811541653.5, dated Jan. 10, 2020. Translation provided by Unitalen Attorneys at Law.
Office Action regarding Chinese Patent Application No. 201811168307.7, dated Mar. 27, 2020. Translation provided by Unitalen Attorneys at Law.
Office Action regarding European Patent Application No. 13859308.2, dated Mar. 4, 2020.
Office Action regarding Korean Patent Application No. 10-2018-0159231, dated Apr. 7, 2020. Translation provided by KS KORYO International IP Law Firm.
Notice of Allowance regarding U.S. Appl. No. 15/682,599 dated Apr. 22, 2020.
China Office Action regarding Application No. 201780055443.2, dated Apr. 14, 2020. Translation provided by Unitalen Attorneys At Law, 8 pages.

* cited by examiner

OIL FLOW THROUGH THE BEARINGS OF A SCROLL COMPRESSOR

CROSS-REFERENCE TO RELATED APPLICATIONS

This application claims the benefit of U.S. Provisional Application No. 62/455,679, filed on Feb. 7, 2017, and U.S. Provisional Application No. 62/384,976, filed on Sep. 8, 2016, and is a continuation-in-part of U.S. application Ser. No. 15/682,599, filed on Aug. 22, 2017. The entire disclosure of each of the applications referenced above is incorporated herein by reference.

FIELD

The present disclosure relates to scroll compressors, and more particularly, to oil flow through the bearings of scroll compressors.

BACKGROUND

This section provides background information related to the present disclosure which is not necessarily prior art.

Scroll compressors are used in applications such as refrigeration systems, air conditioning systems, and heat pump systems to pressurize and, thus, circulate refrigerant within each system. A scroll compressor typically includes an orbiting scroll member having an orbiting scroll wrap and a non-orbiting scroll member having a non-orbiting scroll wrap. As the scroll compressor operates, the orbiting scroll member orbits with respect to a non-orbiting scroll member, causing moving line contacts between flanks of the respective scroll wraps. In so doing, the orbiting scroll member and the non-orbiting scroll member cooperate to define moving, crescent-shaped pockets of vapor refrigerant. The volumes of the pockets decrease as the pockets move toward a center of the scroll members, thereby compressing the vapor refrigerant disposed therein from a suction pressure to a discharge pressure.

During operation, lubricating fluid is provided to many of the moving components of the scroll compressor in an effort to reduce wear, improve performance, and in some instances, to cool one or more components. For example, lubricating fluid in the form of oil may be provided to the orbiting scroll member and to the non-orbiting scroll member such that flanks of the orbiting scroll spiral wrap and flanks of the non-orbiting scroll spiral wrap are lubricated during operation. In a low side compressor, lubricating fluid is typically returned to a sump of the compressor and in so doing may come in contact with a motor of the compressor, thereby cooling the motor to a desired temperature.

SUMMARY

This section provides a general summary of the disclosure, and is not a comprehensive disclosure of its full scope or all of its features.

A compressor according to the principles of the present disclosure includes a shell, a compression mechanism, a driveshaft, a drive bearing cavity, and a drive bearing. The compression mechanism is disposed within the shell and includes an orbiting scroll member and a non-orbiting scroll member. The orbiting scroll member includes a baseplate and a tubular portion extending axially from the baseplate. The tubular portion defines a driveshaft cavity.

The driveshaft is drivingly engaged with the orbiting scroll member. The driveshaft has a first end disposed in the driveshaft cavity of the orbiting scroll member and a second end opposite of the first end. The drive bearing cavity is disposed between an outer radial surface of the driveshaft and an inner radial surface of the tubular portion of the orbiting scroll member. The baseplate of the orbiting scroll member defines a first discharge passage in fluid communication with the drive bearing cavity. The drive bearing is disposed in the drive bearing cavity and is disposed about the driveshaft adjacent to the first end of the driveshaft.

In one configuration, the compressor further includes an unloader bushing disposed about the driveshaft adjacent to the first end of the driveshaft and disposed in the drive bearing cavity between the outer radial surface of the driveshaft and an inner radial surface of the drive bearing.

In one configuration, the driveshaft defines a first channel extending axially through the first end of the driveshaft and a second channel extending radially outward from the first channel and through the outer radial surface of the driveshaft. The first and second channels are configured to deliver discharge fluid from the first discharge passage to an interface between the outer radial surface of the driveshaft and an inner radial surface of the unloader bushing.

In another configuration, the driveshaft defines a third channel extending axially from the first channel and through the second end of the driveshaft.

In another configuration, the main bearing housing is fixed relative to the shell and includes a second tubular portion. The second tubular portion defines a main bearing cavity in fluid communication with the drive bearing cavity. The main bearing is disposed in the main bearing cavity and is disposed about the driveshaft between the first and second ends of the driveshaft. The main bearing radially supports the driveshaft.

In another configuration, the compressor further includes an end bearing disposed about the driveshaft adjacent to the second end. The second tubular portion of the main bearing housing has an open end that allows discharge fluid to flow from the main bearing cavity to the end bearing.

In another configuration, the compressor further includes a suction tube extending through the shell, the non-orbiting scroll member defines a suction inlet in fluid communication with the suction tube, and the baseplate of the orbiting scroll member defines an intermediate chamber orifice disposed radially between the suction inlet and the first discharge passage and extending axially through the baseplate.

In another configuration, the main bearing housing and the orbiting scroll member cooperate to define an intermediate chamber that is in fluid communication with the intermediate chamber orifice.

In another configuration, the compressor further includes an Oldham coupling disposed in the intermediate chamber and keyed to the orbiting scroll member and the main bearing housing to prevent relative rotation between the orbiting and non-orbiting scroll members.

In another configuration, the main bearing housing has a thrust bearing surface abutting the baseplate of the orbiting scroll member, and the intermediate chamber places the intermediate chamber orifice in fluid communication with at least a portion of an interface between the thrust bearing surface and the baseplate.

In another configuration, the shell defines a discharge chamber and the non-orbiting scroll member defines a second discharge passage in fluid communication with the discharge chamber.

In another configuration, the orbiting scroll member has an axial end surface that faces the driveshaft, the first end of the driveshaft is spaced apart from the axial end surface to provide a clearance gap, and the clearance gap is free of any seal that prevents fluid communication between the first discharge passage in the orbiting scroll member and the drive bearing cavity.

In another configuration, the compressor further includes a discharge valve that regulates the flow of discharge fluid from the first discharge passage to the drive bearing cavity.

In another configuration, the discharge valve is disposed in the driveshaft cavity and axially between the orbiting scroll member and the first end of the driveshaft.

Another compressor according to the principles of the present disclosure includes a shell defining a discharge chamber, a suction tube extending through the shell, a compression mechanism, a driveshaft, a drive bearing cavity, and a drive bearing. The compression mechanism is disposed within the shell and includes an orbiting scroll member and a non-orbiting scroll member that cooperate to define a compression pocket. The non-orbiting scroll member defines a suction inlet in fluid communication with the suction tube and a discharge passage in fluid communication with the discharge chamber. The orbiting scroll member includes a baseplate and a first tubular portion extending axially from the baseplate. The first tubular portion defines a driveshaft cavity.

The driveshaft is drivingly engaged with the orbiting scroll member, has a first end disposed in the driveshaft cavity of the orbiting scroll member, and has a second end opposite of the first end. The drive bearing cavity is disposed between an outer radial surface of the driveshaft and an inner radial surface of the first tubular portion of the orbiting scroll member. The baseplate of the orbiting scroll member defines an intermediate chamber orifice in fluid communication with the compression pocket at a location that is radially between the suction inlet and the discharge passage. The intermediate chamber is also in fluid communication with the drive bearing cavity. The drive bearing is disposed in the drive bearing cavity and is disposed about the driveshaft adjacent to the first end of the driveshaft.

In another configuration, the compressor further includes an unloader bushing disposed about the driveshaft adjacent to the first end of the driveshaft and disposed in the drive bearing cavity between the outer radial surface of the driveshaft and an inner radial surface of the drive bearing.

In another configuration, the compressor further includes a main bearing housing and main bearing. The main bearing housing is fixed relative to the shell and includes a second tubular portion. The second tubular portion defines a main bearing cavity in fluid communication with the drive bearing cavity. The main bearing is disposed in the main bearing cavity and is disposed about the driveshaft between the first and second ends of the driveshaft. The main bearing radially supports the driveshaft.

In another configuration, the main bearing housing and the orbiting scroll member cooperate to define an intermediate chamber that is in fluid communication with the intermediate chamber orifice.

In another configuration, the drive bearing cavity and the main bearing cavity are disposed within the intermediate chamber.

In another configuration, the compressor further includes a seal that prevents fluid communication between the intermediate and discharge chambers.

In another configuration, the discharge chamber includes a first portion disposed on a first side of the compression mechanism and a second portion disposed on a second side of the compression mechanism opposite of the first side, the non-orbiting scroll member defines a first fluid passage disposed radially outboard of the discharge passage, and the main bearing housing defines a second fluid passage disposed radially outboard of the main bearing cavity. The first and second fluid passages place the first portion of the discharge chamber in fluid communication with the second portion of the discharge chamber.

In another configuration, the discharge chamber is disposed on a first side of the compression mechanism, the shell defines a suction chamber disposed on a second side of the compression mechanism opposite of the first side, and the suction tube extends through the shell at a location adjacent to the second end of the driveshaft. The suction chamber places the suction inlet in the non-orbiting scroll member in fluid communication with the suction tube.

In another configuration, the location of the suction tube ensures that suction fluid entering the shell passes through an end bearing disposed about the driveshaft adjacent to the second end.

In another configuration, the compressor further includes a deflector configured to redirect suction fluid entering the shell such that the suction fluid flows toward an end bearing disposed about the driveshaft adjacent to the second end.

In another configuration, the intermediate chamber orifice includes a first portion in fluid communication with the compression pocket, a second portion in fluid communication with the drive bearing cavity, and a third portion placing the first and second portions in fluid communication with each other.

In another configuration, the first and third portions of the intermediate chamber orifice extend axially through the baseplate of the orbiting scroll member, and the second portion of the intermediate chamber orifice extends radially through the baseplate of the orbiting scroll member.

Another compressor according to the principles of the present disclosure includes a shell defining a discharge chamber, a compression mechanism disposed within the shell, a driveshaft, a main bearing housing, a main bearing, and a first deflector. The discharge chamber includes a first portion disposed on a first side of the compression mechanism and a second portion disposed on a second side of the compression mechanism opposite of the first side. The compression mechanism includes an orbiting scroll member and a non-orbiting scroll member. The non-orbiting scroll member defines a discharge passage in fluid communication with the first portion of the discharge chamber, and a first fluid passage disposed radially outboard of the discharge passage. The driveshaft is drivingly engaged with the orbiting scroll member.

The main bearing housing is fixed relative to the shell and defines a main bearing cavity, a second fluid passage disposed radially outboard of the main bearing cavity, and a third fluid passage extending through an outer radial surface of the main bearing housing and in fluid communication with the main bearing cavity. The first and second fluid passages place the first portion of the discharge chamber in fluid communication with the second portion of the discharge chamber.

The main bearing is disposed in the main bearing cavity and is disposed about the driveshaft. The main bearing radially supports the driveshaft. The first deflector is disposed in the second portion of the discharge chamber and is configured to redirect discharge fluid flowing axially through the second portion of the discharge chamber such that the discharge fluid flows radially inward toward the third fluid passage in the main bearing housing.

In another configuration, the compressor further includes a second deflector disposed in the first portion of the discharge chamber and configured to redirect discharge fluid flowing radially through the first portion of the discharge chamber such that that discharge fluid flows axially through the first and second fluid passages.

In another configuration, the first deflector has an inlet that is radially aligned with at least one of the first and second fluid passages and an outlet that is axially aligned with the third fluid passage.

In another configuration, the orbiting scroll member defines a driveshaft cavity that receives a first end of the driveshaft, and the compressor further includes a drive bearing cavity and a drive bearing. The drive bearing cavity is in fluid communication with the main bearing cavity and is disposed between an outer radial surface of the driveshaft and an inner radial surface of the orbiting scroll member. The drive bearing is disposed in the drive bearing cavity and is disposed about the driveshaft adjacent to the first end of the driveshaft.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 5:
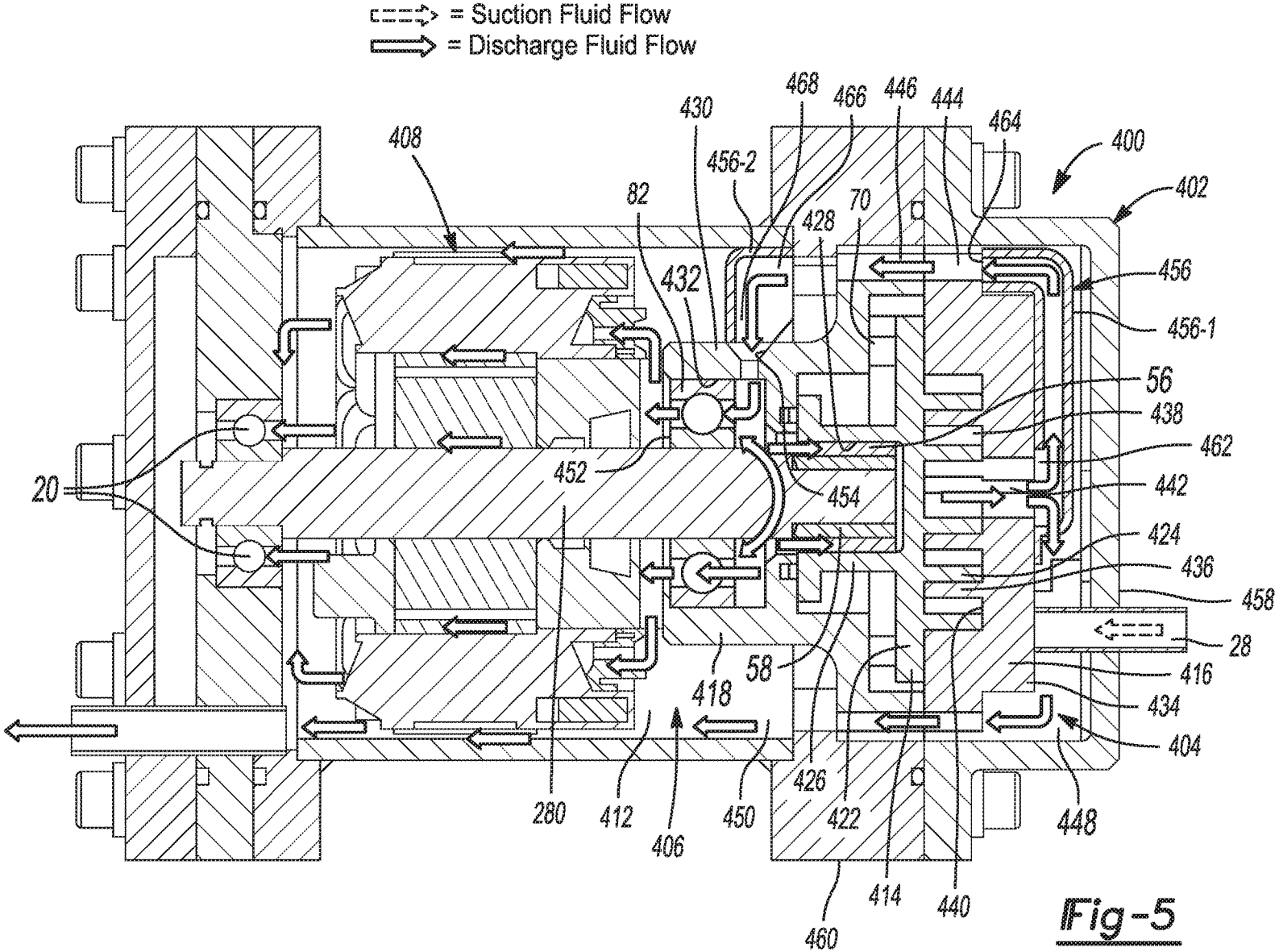
Figure 6:
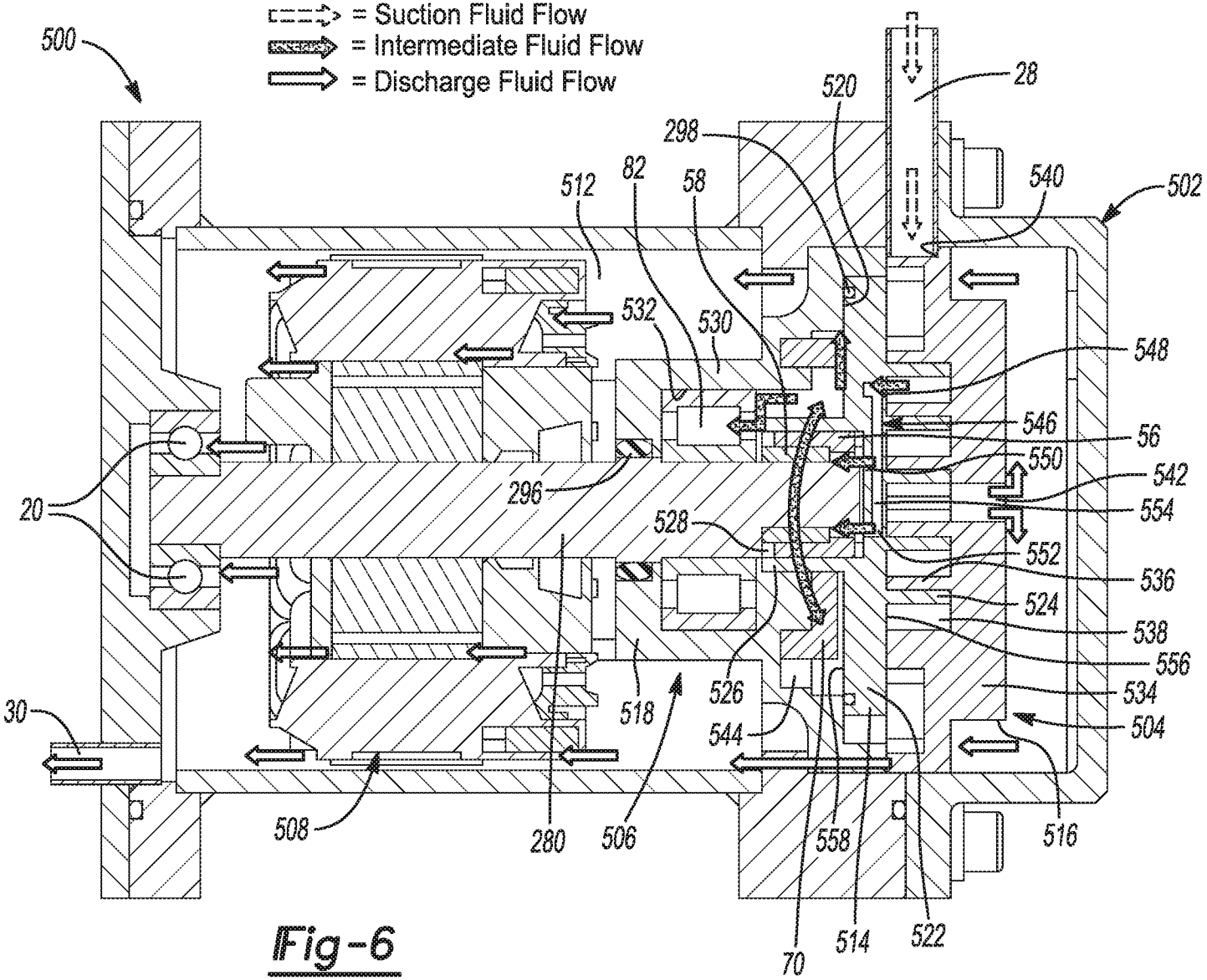

FIG. 5 is a cross-sectional view of an alternate embodiment of a high side compressor having multiple deflectors to aid in oil delivery to bearings; and FIG. 6 is a cross-sectional view of an alternate embodiment of a high side compressor having an intermediate chamber in which bearings and an unloader bushing are disposed, and an intermediate chamber orifice extending radially through an orbiting scroll member to aid in oil delivery to the bearings and the unloader bushing.

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
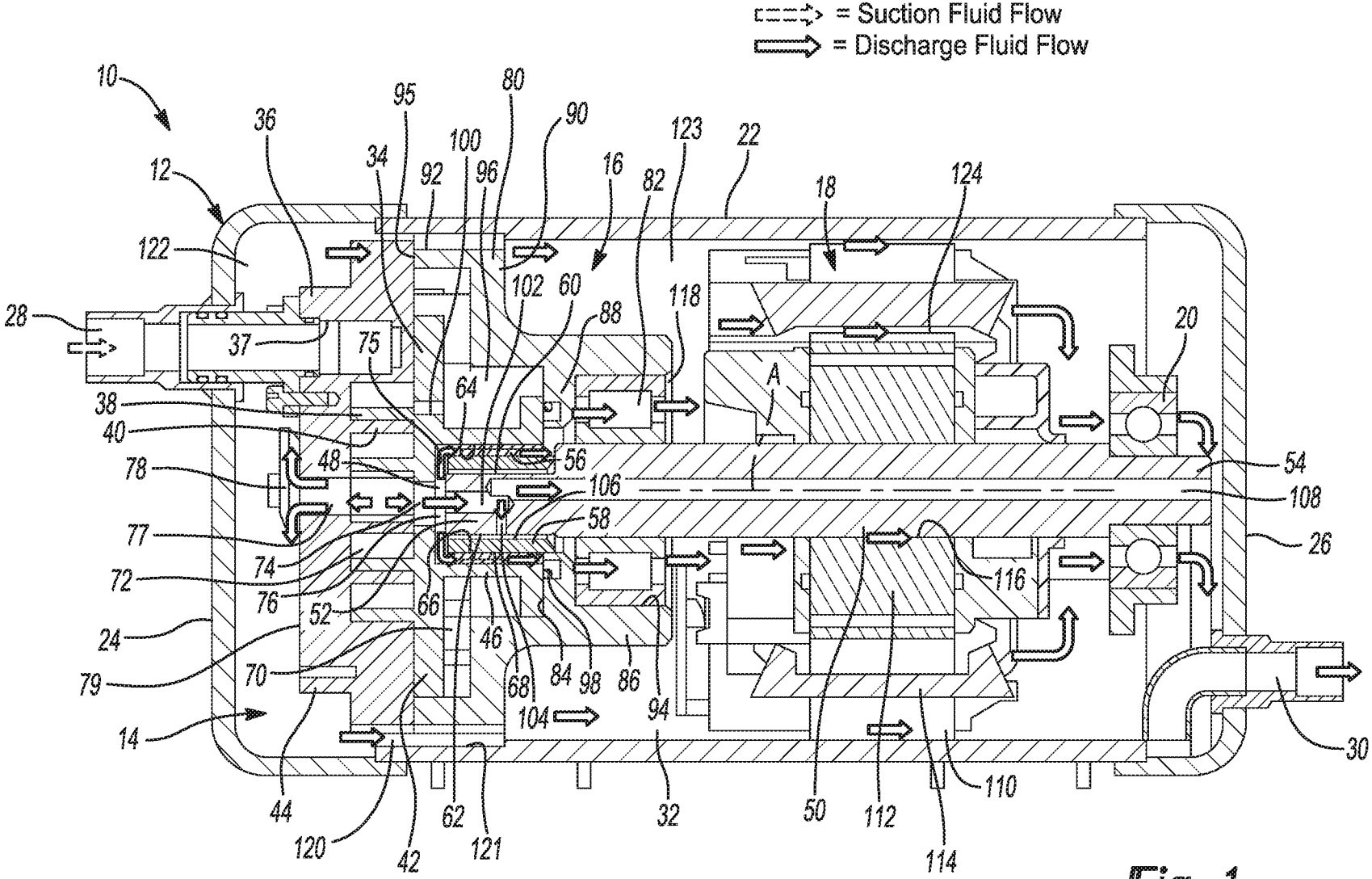
FIG. 1 is a cross-sectional view of a high side compressor in accordance with the present disclosure.

With reference to FIG. 1, a compressor 10 is provided that includes a cylindrical shell 12, a compression mechanism 14, a bearing housing assembly 16, a motor assembly 18, and an end bearing 20. While the compressor 10 shown in FIG. 1 is a rotary-vane compressor and a high-side-compressor (i.e., where the motor assembly 18 is disposed in a discharge-pressure chamber of the shell 12), the principles of the present disclosure are suitable for incorporation in many different types of compressors, including hermetic compressors, non-hermetic compressors, open drive compressors, low-side compressors (i.e., where the motor assembly 18 is disposed in a suction-pressure chamber of the shell 12), and high-side compressors. Furthermore, while FIG. 1 depicts the compressor 10 as a horizontal compressor, in some configurations, the compressor 10 may be a vertical compressor with the motor assembly 18 disposed vertically above or below the compression mechanism 14 and the bearing housing assembly 16.

The shell 12 houses the compression mechanism 14, the bearing housing assembly 16, the motor assembly 18, and the end bearing 20. The shell 12 includes a cylindrical main body 22, a first end cap 24 that fits over and sealing engages one end of the main body 22, and a second end cap 26 that fits over and sealing engages the other end of the main body 22. A suction tube 28 extends through the first end cap 24 of the shell 12 and receives a working fluid at a suction pressure from one of an indoor and outdoor heat exchanger (not shown) of a climate control system. A discharge tube 30 extends through the second end cap 26 of the shell 12 and discharges the working fluid to the other of the indoor and outdoor heat exchanger after it has been compressed by the compression mechanism 14.

The shell 12 defines a discharge chamber 32 (containing discharge-pressure fluid) in which the compression mechanism 14, the bearing housing assembly 16, the motor assembly 18, and the end bearing 20 are disposed. In FIG. 1, the compressor 10 is depicted as a sumpless compressor—i.e., the compressor 10 does not include a lubricant sump. Instead, lubricating fluid entrained in working fluid discharged from the compression mechanism 14 circulates throughout the shell 12 and lubricates various moving components of the compressor 10. However, in various configurations, the compressor 10 may include a sump.

The compression mechanism 14 includes an orbiting scroll member 34 and a non-orbiting scroll member 36. The non-orbiting scroll member 36 is fixed to the shell 12 (e.g., by press fit and/or staking) and/or to the bearing housing assembly 16 (e.g., by a plurality of fasteners). The non-orbiting scroll member 36 has a suction inlet 37 in fluid communication with the suction tube 28. The orbiting and non-orbiting scroll members 34, 36 include orbiting and non-orbiting spiral wraps (or vane) 38, 40, respectively, that meshingly engage each other and extend axially from orbiting and non-orbiting baseplates 42, 44, respectively. The orbiting scroll member 34 further includes a tubular portion 46 that extends axially from the side of the orbiting baseplate 42 that is opposite of the side of the baseplate 42 from which the orbiting spiral wraps 38 extend. The tubular portion 46 defines a driveshaft cavity 48.

A driveshaft 50 rotates about a rotational axis A and has a first end 52 disposed in the driveshaft cavity 48 and a second end 54 opposite of the first end 52. The driveshaft 50 drivingly engages the orbiting scroll member 34, via a drive bearing 56 and an unloader bushing 58, to cause orbital movement of the orbiting scroll member 34 relative to the non-orbiting scroll member 36. The drive bearing 56 and the unloader bushing 58 are disposed in a drive bearing cavity 60, which is disposed between an outer radial surface 62 of the driveshaft 50 and an inner radial surface 64 of the tubular portion 46 of the orbiting scroll member 34. The drive bearing 56 and/or the unloader bushing 58 can be made from steel or other materials used in rolling element bearing designs. The drive bearing 56 can be press fit into the drive bearing cavity 60 of the orbiting scroll member 34. The unloader bushing 58 may be coupled to the driveshaft 50 in a manner that ensures that the unloader bushing 58 rotates or orbits with the driveshaft 50 while allowing some radial compliance between the driveshaft 50 and the unloader bushing 58. For example, the outer radial surface 62 of the driveshaft 50 may include a flat portion that engages a flat portion on an inner radial surface 106 of the unloader bushing 58 to prevent the unloader bushing 58 from rotating relative to the driveshaft 50. In addition, the unloader bushing 58 may include a spring disposed between the outer radial surface 62 of the driveshaft 50 and the inner radial surface 106 of the unloader bushing 58, and the compliance of the spring may allow the orbiting scroll member 34 to move radially relative to the driveshaft 50. The orbiting scroll member 34 may only move radially relative to the driveshaft 50 when a radial force applied to the orbiting scroll member 34 is greater than a biasing force of the spring.

The unloader bushing 58 is disposed about the driveshaft 50 adjacent to the first end 52 of the driveshaft 50 and is disposed between the outer radial surface 62 of the driveshaft 50 and an inner radial surface 66 of the drive bearing 56. The drive bearing 56 is disposed about the driveshaft 50 adjacent to the first end 52 of the driveshaft 50 and is disposed between an outer radial surface 68 of the unloader bushing 58 and the inner radial surface 64 of the tubular portion 46 of the orbiting scroll member 34. Although radial gaps are shown between the driveshaft 50, the unloader bushing 58, the drive bearing 56, and the orbiting scroll member 34 to illustrate fluid flow between these components, these components may engage one another such that rotation of the driveshaft 50 is transferred to the orbiting scroll member 34.

An Oldham coupling 70 is keyed to the orbiting scroll member 34 and a stationary structure (e.g., the bearing housing assembly 16 or the non-orbiting scroll member 36) to prevent relative rotation between the orbiting and non-orbiting scroll members 34, 36 while allowing the orbiting scroll member 34 to move in an orbital path relative to the non-orbiting scroll member 36. Compression pockets 72 are formed between the orbiting and non-orbiting spiral wraps 38, 40 that decrease in size as they move from a radially outer position to a radially inner position, thereby compressing the working fluid therein from the suction pressure to the discharge pressure.

The baseplate 42 of the orbiting scroll member 34 defines a discharge passage 74 that extends axially through the baseplate 42 and discharges working fluid to the drive bearing cavity 60 after it has been compressed by the compression mechanism 14. The discharge passage 74 is located at or near the center of the orbiting scroll member 34 in the radial direction. The orbiting scroll member has an axial end surface 75 that faces the driveshaft 50, and the first end 52 of the driveshaft 50 is spaced apart from the axial end surface 75 to provide a clearance gap 76. The clearance gap 76 is free of any seal that prevents fluid communication between the discharge passage 74 in the orbiting scroll member 34 and the drive bearing cavity 60. Thus, the discharge passage 74 is in fluid communication with the drive bearing cavity 60, which is disposed within the discharge chamber 32, and lubricating fluid entrained in the discharge fluid lubricates the drive bearing 56 and the unloader bushing 58.

In the configuration shown in FIG. 1, the baseplate 44 of the non-orbiting scroll member 36 defines a discharge passage 77 that extends axially through the baseplate 44 and discharges working fluid to the discharge chamber 32 after it has been compressed by the compression mechanism 14. In addition, a discharge valve 78 regulates the flow of the discharge fluid through the discharge passage 77 in the non-orbiting scroll member 36. The discharge valve 78 may be a reed valve, a disc valve, or any other type of dynamic valve. The discharge passage 77 in the non-orbiting scroll member 36 may be at least partially aligned with the discharge passage 74 in the orbiting scroll member 34 in the radial direction. In various configurations, the discharge passage 77 and the discharge valve 78 may be omitted, which would enable reducing the size of the compressor 10 by reducing the size of (or eliminating) the gap between an axial end surface 79 of the non-orbiting scroll member 36 and the first end cap 24 of the shell 12.

The bearing housing assembly 16 includes a main bearing housing 80 and a main bearing 82. The main bearing housing 80 is fixed relative to the shell 12 and defines a thrust bearing surface 84 for the orbiting scroll member 34. Also, in configurations where the compressor 10 is a vertical compressor, the main bearing housing 80 may support the non-orbiting scroll member 36. The main bearing housing 80 and the main bearing 82 radially support the driveshaft 50.

The main bearing housing 80 includes a first tubular portion 86, a first annular portion 88 that projects radially inward from the first tubular portion 86, a second annular portion 90 that projects radially outward from the first tubular portion 86, and a second tubular portion 92 that extends axially from the outer radial ends of the second annular portion 90. The first tubular portion 86 of the main bearing housing 80 defines a main bearing cavity 94 that receives the main bearing 82 and the driveshaft 50, and that is in fluid communication with the drive bearing cavity 60. Thus, discharge fluid flows from the drive bearing cavity 60 to the main bearing cavity 94, and lubricating fluid entrained in discharge gas lubricates the main bearing 82. The first annular portion 88 of the main bearing housing 80 defines the thrust bearing surface 84. The second tubular portion 92 of the main bearing housing 80 defines an antithrust surface 95 that abuts the non-orbiting scroll member 36.

The orbiting and non-orbiting scroll members 34, 36 and the main bearing housing 80 cooperate to define an intermediate chamber 96 that is disposed between the orbiting and non-orbiting scroll members 34, 36 and the main bearing housing 80. The Oldham coupling 70 is disposed in the intermediate chamber 96. An annular seal 98 is disposed at an interface between the orbiting scroll member 34 and the main bearing housing to prevent fluid communication between the intermediate chamber 96 and the discharge chamber 32.

The baseplate 42 of the orbiting scroll member 34 defines an intermediate chamber orifice 100 that extends axially through the baseplate 42 and is disposed radially between the discharge passage 74 and the suction inlet 37. The intermediate chamber orifice 100 places the compression pockets 72 in fluid communication with the intermediate chamber 96, thereby allowing working fluid at an intermediate pressure (i.e., a pressure greater than the suction pressure and less than the discharge pressure) to flow between the compression pockets 72 and the intermediate chamber 96. Lubricating fluid entrained in the intermediate fluid lubricates the Oldham coupling 70, the interface between the thrust bearing surface 84 of the main bearing housing 80 and the orbiting scroll member 34, and the interface between the antithrust surface 95 of the main bearing housing 80 and the non-orbiting scroll member 36.

The driveshaft 50 defines a first channel 102 extending axially through the first end 52 of the driveshaft 50 and a second channel 104 extending radially outward from the first channel 102 and through the outer radial surface 62 of the driveshaft 50. Discharge gas from the discharge passage 74 of the orbiting scroll member 34 and lubricating fluid entrained in the discharge gas may flow though the first and second channels 102, 104 and may lubricate the interface between the outer radial surface 62 of the driveshaft 50 and the inner radial surface 106 of the unloader bushing 58. In the configuration shown in FIG. 1, the driveshaft 50 also defines a third channel 108 extending axially from the first channel 102 and through the second end 54 of the driveshaft 50. However, in various configurations, the driveshaft 50 may define the first and second channels 102, 104 without also defining the third channel 108.

The motor assembly 18 includes a stator 110 and a rotor 112. The motor assembly 18 can be a fixed-speed motor or a variable-speed motor. In some configurations, the motor assembly 18 may be an induction motor. In other configurations, the motor assembly 18 may be a switched reluctance motor. The stator 110 is disposed about the rotor 112 and includes a conductive member 114, such as copper wire, that generates a magnetic field, which causes the rotor 112 to rotate about the rotational axis A.

The rotor 112 is disposed about the stator 110 and is coupled to the driveshaft 50. In this regard, the rotor 112 may transmit rotational power to the driveshaft 50. The rotor 112 defines a central aperture 116 that receives the driveshaft 50 and is disposed about a portion of the driveshaft 50 located between the first and second ends 52, 54 of the driveshaft 50. The rotor 112 may be fixed relative to the driveshaft 50 by press fitting the driveshaft 50 within the central aperture 116. One or more additional or alternative means for fixing the driveshaft 50 to the rotor 112 could be employed, such as threaded engagement, adhesive bonding and/or fasteners, for example.

The first tubular portion 86 of the main bearing housing has an open end 118 that allows discharge fluid to flow from the main bearing cavity 94 to the motor assembly 18. In addition, discharge fluid expelled through the discharge passage 77 in the non-orbiting scroll member 36 may flow radially outward and then axially past the compression mechanism 14 and the bearing housing assembly 16 to the motor assembly 18. In this regard, the non-orbiting scroll member 36 may define one or more fluid passages 120 extending axially through the non-orbiting scroll member 36, and the main bearing housing 80 may define one or more fluid passages 121 that extend axially through the main bearing housing 80 and that are radially aligned with the fluid passages 120. Thus, the discharge fluid expelled through the discharge passage 77 may flow through the fluid passages 120, 121 in the non-orbiting scroll member 36 and the main bearing housing 80, respectively, and to the motor assembly 18. In this regard, the discharge chamber 32 includes a first portion 122 disposed on a first side of the compression mechanism 14 and a second portion 123 disposed on a second side of the compression mechanism 14 opposite of the first side, and the fluid passages 120, 121 place the first portion 122 of the discharge chamber 32 in fluid communication with the second portion 123 of the discharge chamber 32.

Lubricating fluid entrained in the discharge fluid that flows to the motor assembly 18 may lubricate the interface between the shell 12 and the stator 110 and the interface between the rotor 112 and the driveshaft 50. In addition, the stator 110 may define one or more fluid passages 124 extending axially through the stator 110 and allowing the discharge fluid to flow through the stator 110 to the end bearing 20.

The end bearing 20 is disposed about the driveshaft 50 adjacent to the second end 54 of the driveshaft 50 and radially supports the driveshaft 50. Discharge fluid flows through the end bearing 20 after it passes through the motor assembly 18, and lubricating fluid entrained in the discharge fluid lubricates the end bearing 20. The discharge fluid then exits the compressor 10 through the discharge tube 30. When the compressor 10 is a horizontal compressor as depicted in FIG. 1, the discharge tube 30 may be located near the bottom of the compressor 10 as shown in FIG. 1 so that little to no lubricating fluid accumulates in the compressor 10. This ensures that the amount of lubricating fluid flowing through the compressor 10 is constant or fixed.

Figure 2:
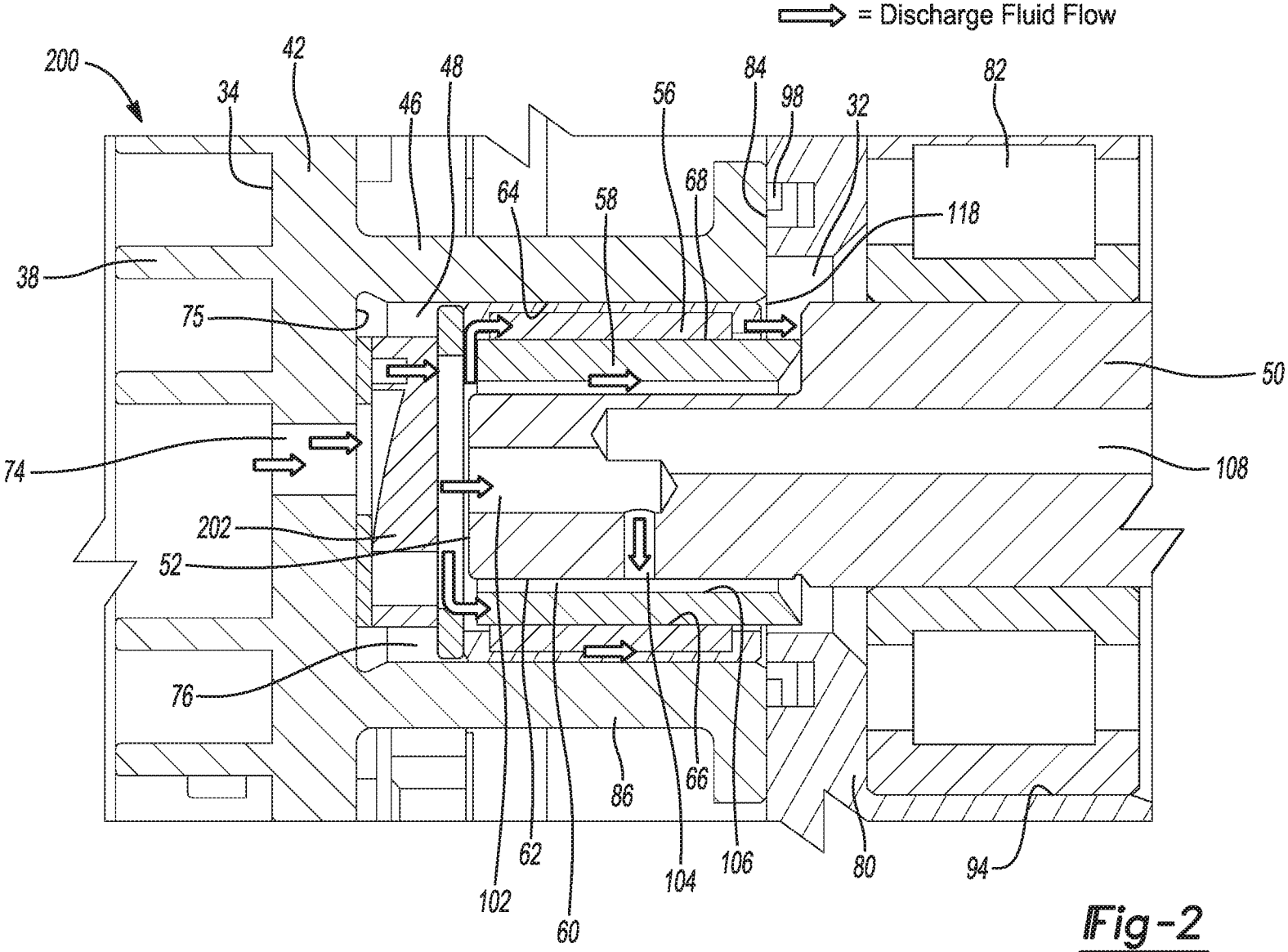
FIG. 2 is a cross-sectional view of a portion of an alternate embodiment of a high side compressor including a discharge valve that regulates the flow of discharge fluid through a discharge passage in an orbiting scroll member.

With reference to FIG. 2, another high side compressor 200 is provided. The compressor 200 is similar or identical to the compressor 10 described above, except that the compressor 200 includes a discharge valve 202 that regulates the flow of discharge fluid through the discharge passage 74 to the drive bearing cavity 60. Otherwise, the structure and function of the compressor 200 is similar or identical to that of the compressor 10 described above, apart from any exceptions described below and/or shown in the figures.

The discharge valve 202 is disposed in the clearance gap 76 between the axial end surface 75 of the orbiting scroll member 34 and the first end 52 of the driveshaft 50. The discharge valve 202 can be any type of valve such as a reed valve or a disc valve. The discharge valve 202 may be a one-way valve that allows discharge fluid from the discharge passage 74 to flow to the drive bearing cavity 60 while preventing discharge fluid in the drive bearing cavity 60 from flowing to the discharge passage 74. The discharge valve 202 may enable to compressor 200 to achieve a higher compression ratio (i.e., a ratio the pressure of the discharge fluid exiting the compressor 200 to the pressure of the suction fluid entering the compressor 200) than would otherwise be possible without the discharge valve 202.

Figure 3:
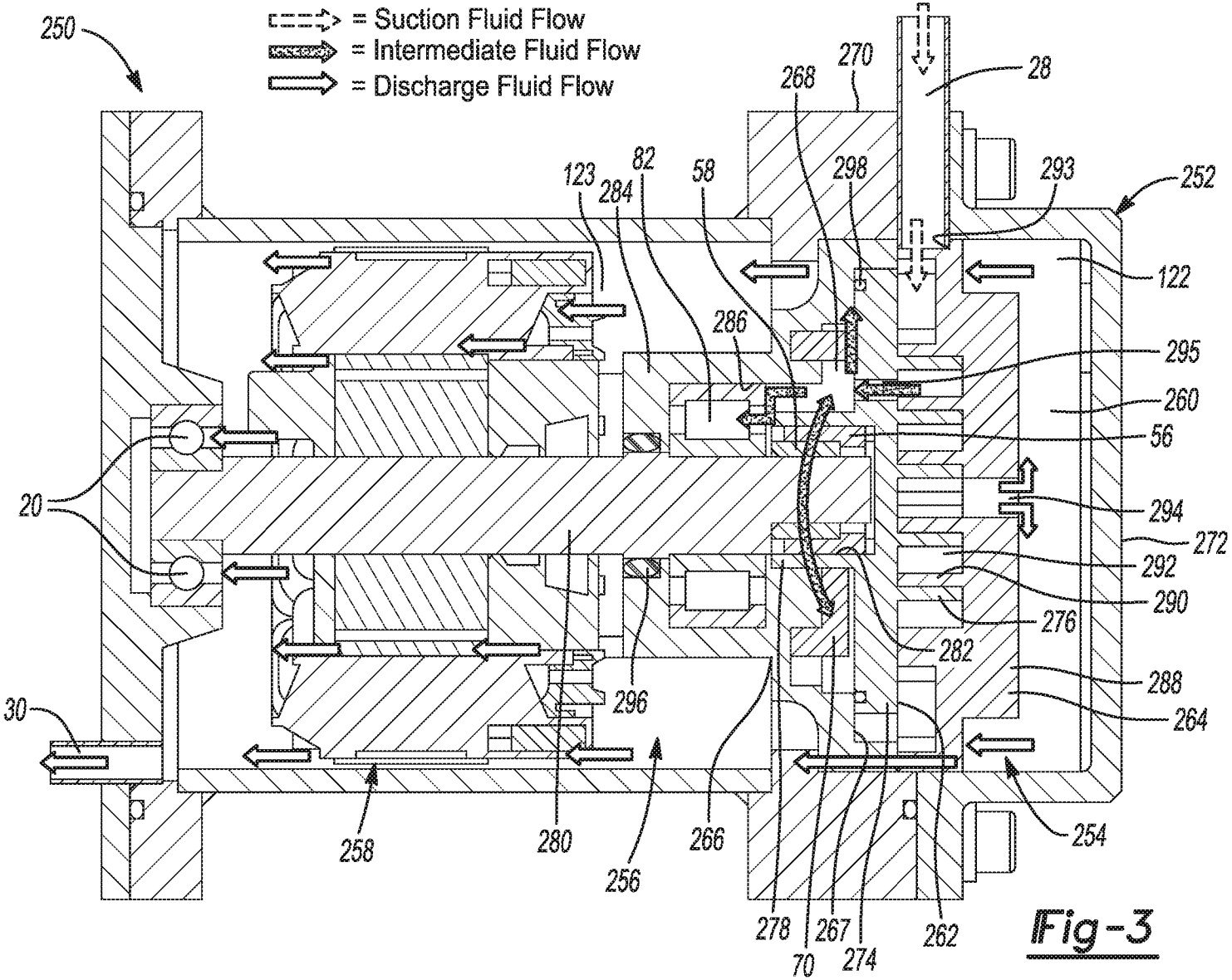
FIG. 3 is a cross-sectional view of an alternate embodiment of a high side compressor having an intermediate chamber in which bearings and an unloader bushing are disposed.

With reference to FIG. 3, another high side compressor 250 is provided that includes a cylindrical shell 252, a compression mechanism 254, a bearing housing assembly 256, a motor assembly 258, and the end bearing 20. The shell 252 defines a discharge chamber 260 in which the compression mechanism 254, the bearing housing assembly 256, the motor assembly 258, and the end bearing 20 are disposed. The compression mechanism 254 includes an orbiting scroll member 262 and a non-orbiting scroll member 264, and the bearing housing assembly 256 includes a main bearing housing 266 and the main bearing 82. The main bearing housing 266 is fixed relative to the shell 252 and defines a thrust bearing surface 267 for the orbiting scroll member 262.

The compressor 250 is similar or identical to the compressor 10 described above except that the orbiting scroll member 262 does not define a discharge passage such as the discharge passage 74, and only the orbiting scroll member 262 and the main bearing housing 266 cooperate to define an intermediate chamber 268 (i.e., the non-orbiting scroll member 264 does not cooperate with the orbiting scroll member 262 and the main bearing housing 266 to define the intermediate chamber 268). In addition, the drive bearing 56, the unloader bushing 58, and the main bearing 82 are located inside the intermediate chamber 268 rather than in the discharge chamber 260. Further, the shell 252 has a slightly different shape than the shell 12, and the suction tube 28 extends through an outer radial surface 270 of the shell 252 instead of through an axial end surface 272 of the shell 252. Otherwise, the structure and function of the compressor 200 is similar or identical to that of the compressor 10 described above, apart from any exceptions described below and/or shown in the figures.

Like the orbiting scroll member 34, the orbiting scroll member 262 includes a baseplate 274, a spiral wrap (or vane) 276 extending axially from the baseplate 274, and a tubular portion 278 extending axially from the baseplate 274 in an opposite direction than the spiral wrap 276. In addition, the orbiting scroll member 262 is driven by a driveshaft 280, and the tubular portion 278 defines a drive bearing cavity 282 in which the drive bearing 56 is disposed. Further, the main bearing housing 266 includes a tubular portion 284 that defines a main bearing cavity 286 in which the main bearing 82 is disposed.

Like the non-orbiting scroll member 36, the non-orbiting scroll member 264 includes a baseplate 288 and a spiral wrap (or vane) 290 extending axially from the baseplate 288 toward the orbiting scroll member 34. The spiral wrap 290 of the non-orbiting scroll member 264 cooperates with the spiral wrap 276 of the orbiting scroll member 262 to define compression pockets 292 that decrease in size as they move from a radially outer position to a radially inner position, thereby compressing the working fluid therein from the suction pressure to the discharge pressure. In addition, the non-orbiting scroll member 264 has a suction inlet 293 in fluid communication with the suction tube 28, and the baseplate 288 of the non-orbiting scroll member 264 defines a discharge passage 294 that extends axially through the baseplate 288 and allows discharge fluid to enter the discharge chamber 260. Further, the orbiting and non-orbiting scroll members 262, 264 may define fluid passages, such as the fluid passages 120, 121 of the compressor 10, which place one portion of the discharge chamber 260 disposed on a first side of the compression mechanism 254 in communication with another portion of the discharge chamber 260 disposed on a second side of the compression mechanism 254 opposite of the first side.

Also, like the orbiting scroll member 34, the baseplate 274 of the orbiting scroll member 262 defines an intermediate chamber orifice 295 that extends axially through the baseplate 274 and is disposed radially between the discharge passage 294 and the suction inlet 293. The intermediate chamber orifice 295 places the compression pockets 292 in fluid communication with the intermediate chamber 268, thereby allowing working fluid at an intermediate pressure (i.e., a pressure greater than the suction pressure and less than the discharge pressure) to flow between the compression pockets 292 and the intermediate chamber 268. Lubricating fluid entrained in the intermediate fluid lubricates the Oldham coupling 70 and the interface between the thrust bearing surface 267 of the main bearing housing 266 and the orbiting scroll member 262.

In contrast to the compressor 10, there is no seal in the compressor 250, such as the annular seal 98, which prevents fluid communication between the intermediate chamber 268 and the drive bearing cavity 282. In addition, the driveshaft 280 does not define a channel, such as the first, second, and third channels 102, 104, 108, which allow fluid to pass through the driveshaft 280. Further, in contrast to the open end 118 of the main bearing housing 80, the compressor 250 includes an annular seal 296 that prevents fluid communication between the main bearing cavity 286 and the discharge chamber 260. The compressor 250 also includes an annular seal 298 that seals the interface between the thrust bearing surface 267 of the main bearing housing 266 and the orbiting scroll member 262. Thus, the drive bearing cavity 282 and the main bearing cavity 286 are disposed in the intermediate chamber 268 rather than the discharge chamber 260. As a result, the drive bearing 56, the unloader bushing 58, and the main bearing 82 are lubricated by lubricating fluid entrained in intermediate fluid rather than by lubricating fluid entrained in discharge fluid. Since the pressure and temperature of the intermediate fluid is less than that of the discharge fluid, the viscosity of the lubricating fluid entrained in the intermediate fluid is greater than that of the lubricating fluid entrained in the discharge fluid. Lubricating the drive bearing 56, the unloader bushing 58, and the main bearing 82 with a lubricating fluid having a higher viscosity increases the life of the bearings 56, 82 and improves the lubrication at the interface between the driveshaft 280 and the unloader bushing 58.

Figure 4:
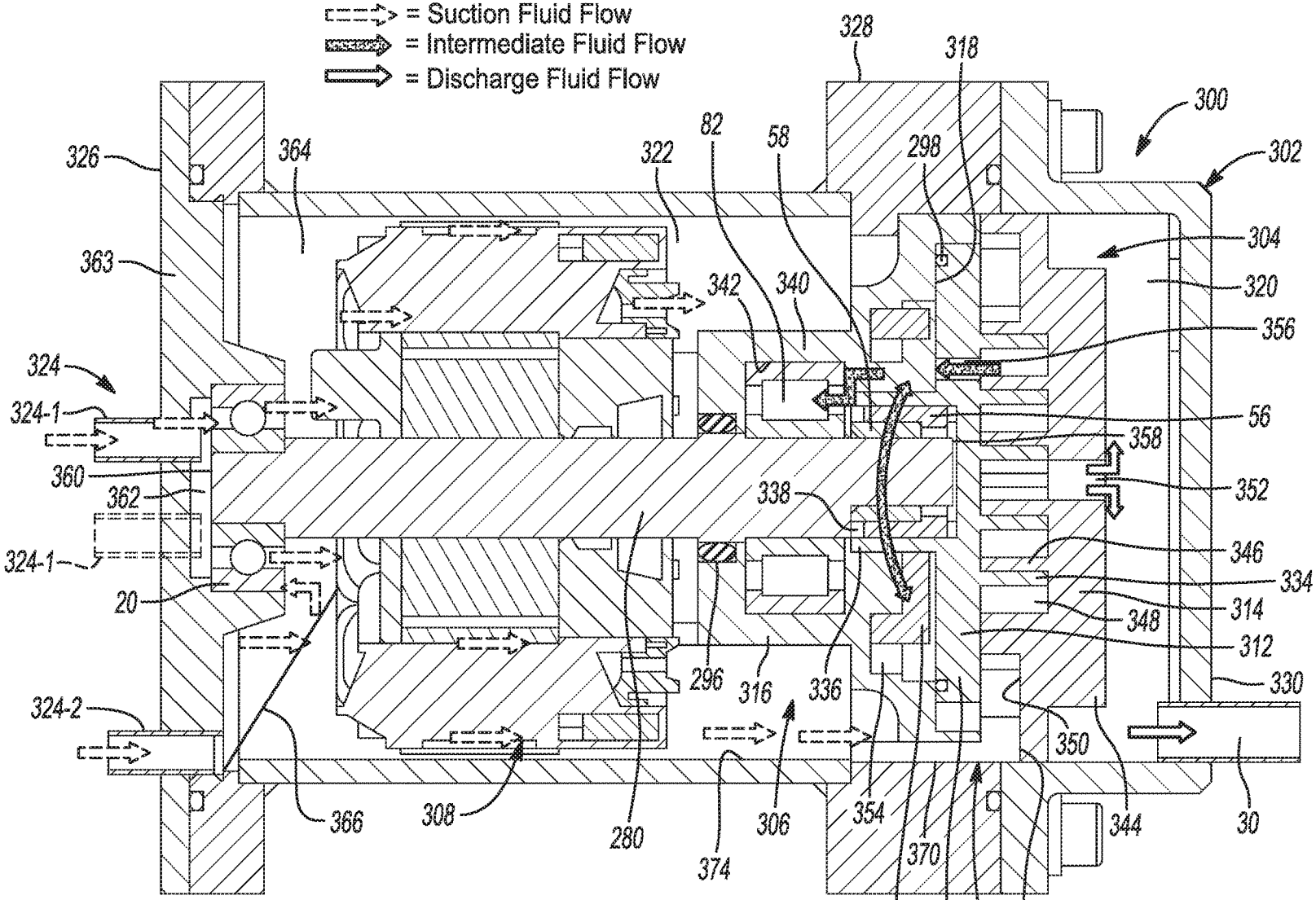
FIG. 4 is a cross-sectional view of a low side compressor in accordance with the present disclosure, the compressor having an intermediate chamber in which bearings and an unloader bushing are disposed, and a deflector to aid in oil delivery to a bearing disposed outside of the intermediate chamber.

With reference to FIG. 4, a low side compressor 300 is provided that includes a cylindrical shell 302, a compression mechanism 304, a bearing housing assembly 306, a motor assembly 308, and the end bearing 20. The compression mechanism 304 includes an orbiting scroll member 312 and a non-orbiting scroll member 314, and the bearing housing assembly 306 includes a main bearing housing 316 and the main bearing 82. The main bearing housing 316 is fixed relative to the shell 302 and defines a thrust bearing surface 318 for the orbiting scroll member 312.

The compressor 300 is similar or identical to the compressor 250 described above except that the orbiting and non-orbiting scroll members 312, 314 does not define fluid passages, such as the fluid passages 120, 121, which place a first side of the compression mechanism 304 in communication with a second side of the compression mechanism 304 opposite of the first side. Instead, the shell 302 defines a discharge chamber 320 disposed on the first side of the compression mechanism 304 and a suction chamber 322 disposed on the second side of the compression mechanism 304, and the compression mechanism 304 prevents fluid communication between the discharge and suction chambers 320, 322. In addition, a pair of suction tubes 324 extend through an axial end surface 326 of the shell 302 rather than a single suction tube extending through an outer radial surface 328 of the shell 302, and the discharge tube 30 extends through an axial end surface 330 rather than extending through the axial end surface 326. Otherwise, the structure and function of the compressor 300 is similar or identical to that of the compressor 250 described above, apart from any exceptions described below and/or shown in the figures.

Like the orbiting scroll member 262, the orbiting scroll member 312 includes a baseplate 332, a spiral wrap (or vane) 334 extending axially from the baseplate 332, and a tubular portion 336 extending axially from the baseplate 332 in an opposite direction than the spiral wrap 334. In addition, the orbiting scroll member 312 is driven by the driveshaft 280, and the tubular portion 336 defines a drive bearing cavity 338 in which the drive bearing 56 is disposed. Further, the main bearing housing 316 includes a tubular portion 340 that defines a main bearing cavity 342 in which the main bearing 82 is disposed.

Like the non-orbiting scroll member 264, the non-orbiting scroll member 314 includes a baseplate 344 and a spiral wrap (or vane) 346 extending axially from the baseplate 344 toward the orbiting scroll member 262. The spiral wrap 346 of the non-orbiting scroll member 314 cooperates with the spiral wrap 334 of the orbiting scroll member 312 to define compression pockets 348 that decrease in size as they move from a radially outer position to a radially inner position, thereby compressing the working fluid therein from the suction pressure to the discharge pressure. In addition, the non-orbiting scroll member 314 has a suction inlet 350 in fluid communication with the suction tubes 324 via the suction chamber 322, and the baseplate 344 of the non-orbiting scroll member 314 defines a discharge passage 352 that extends axially through the baseplate 344 and allows discharge fluid to enter the discharge chamber 320.

In the compressor 300, similar to the compressor 250, the orbiting scroll member 312 and the main bearing housing 316 cooperate to define an intermediate chamber 354. In addition, the drive bearing 56, the unloader bushing 58, and the main bearing 82 are located inside the intermediate chamber 354. Further, the annular seals 296, 298 prevent fluid communication between the suction chamber 322 and the intermediate chamber 354.

Also, like the orbiting scroll member 262, the baseplate 332 of the orbiting scroll member 312 defines an intermediate chamber orifice 356 that extends axially through the baseplate 332 and is disposed radially between the discharge passage 352 and the suction inlet 350. The intermediate chamber orifice 356 places the compression pockets 348 in fluid communication with the intermediate chamber 354, thereby allowing working fluid at an intermediate pressure (i.e., a pressure greater than the suction pressure and less than the discharge pressure) to flow between the compression pockets 348 and the intermediate chamber 354. Lubricating fluid entrained in the intermediate fluid lubricates the drive bearing 56, the unloader bushing 58, and the main bearing 82, the Oldham coupling 70, and at least a portion of the thrust bearing surface 318.

The driveshaft 280 has a first end 358 and a second end 360, and the end bearing 20 is disposed about the driveshaft 280 adjacent to the second end 360. The suction tubes 324 include a first suction tube 324-1 disposed adjacent to the end bearing 20 and a second suction tube 324-2 disposed radially outboard of the first suction tube 324-1. In various configurations, one of the first and second suction tubes 324-1 and 324-2 may be omitted.

The location of the first suction tube 324-1 ensures that suction fluid entering the shell 302 through the first suction tube 324-1 passes through the end bearing 20. In the example shown in FIG. 4, the first suction tube 324-1 extends into a first portion 362 of the suction chamber 322 disposed between an end cap 363 of the shell 302 and the second end 360 of the driveshaft 280. FIG. 4 shows one possible location of the first suction tube 324-1 represented by solid lines, and another possible location of the first suction tube 324-1 represented by phantom lines. In either case, the first suction tube 324-1 extends into the first portion 362 of the suction chamber 322. The first portion 362 is disposed on a first side of the end bearing 20, and a second portion 364 of the suction chamber 322 is disposed on a second side of the end bearing 20 that is opposite of the first side. Thus, in order to flow from the first portion 362 of the suction chamber 322 to the second portion 364 of the suction chamber 322, the suction fluid entering the shell 302 through the first suction tube 324-1 must pass through the end bearing 20.

While the second suction tube 324-2 does not extend into the first portion 362 of the suction chamber 322, a deflector 366 redirects suction fluid entering the shell 302 through the second suction tube 324-2 to ensure that the suction fluid passes through the end bearing 20. As shown in FIG. 4, the deflector 366 is oriented at an oblique angle relative to the second suction tube 324-2 such that suction fluid flowing axially in a first direction from the second suction tube 324-2 is redirected to flow radially inward and axially in a second direction opposite of the first direction. The deflector 366 may be a flat or curved plate, and may extend around the entire circumference of the driveshaft 280 or only a portion thereof. In the example shown in FIG. 4, the deflector 366 extends around only a portion of the circumference of the driveshaft 280. If the deflector 366 is a curved plate that extends around the entire circumference of the driveshaft 280, the deflector 366 may have a hollow conical or funnel shape.

After passing through the end bearing 20, the suction fluid passes through the motor assembly 308 and flows to a suction guide 368. As shown in FIG. 4, the suction guide 368 includes a first segment 370 and a second segment 372. The first segment 370 is disposed radially outboard of the main bearing housing 316 and extends axially from the suction chamber 322 to the second segment 372. The second segment extends radially from the first segment 370 to the suction inlet 350. Thus, the suction guide 368 provides a path for suction fluid to flow from the suction chamber 322 to the suction inlet 350.

As shown in FIG. 4, the compressor 300 is a horizontal compressor. Thus, lubricating fluid may accumulate at a bottom 374 of the suction chamber 322. However, if this occurs, suction fluid flowing from the suction tubes 324 to the suction inlet 350 will lift the lubricating fluid from the bottom 374 of the suction chamber 322 and carry the lubricating fluid to the suction inlet 350. In addition, the suction guide 368 may be located at the bottom 374 of the suction chamber 322 as shown in FIG. 4 to ensure that the amount of lubricating fluid that accumulates at the bottom 374 is minimal.

With reference to FIG. 5, another high side compressor 400 is provided that includes a cylindrical shell 402, a compression mechanism 404, a bearing housing assembly 406, a motor assembly 408, and the end bearing 20. The shell 402 defines a discharge chamber 412 in which the compression mechanism 404, the bearing housing assembly 406, the motor assembly 408, and the end bearing 20 are disposed. The compression mechanism 404 includes an orbiting scroll member 414 and a non-orbiting scroll member 416, and the bearing housing assembly 406 includes a main bearing housing 418 and the main bearing 82. The main bearing housing 418 is fixed relative to the shell 402.

The orbiting scroll member 414 includes a baseplate 422, a spiral wrap (or vane) 424 extending axially from the baseplate 422, and a tubular portion 426 extending axially from the baseplate 422 in an opposite direction than the spiral wrap 424. In addition, the orbiting scroll member 414 is driven by the driveshaft 280, and the tubular portion 426 defines a drive bearing cavity 428 in which the drive bearing 56 is disposed. Further, the main bearing housing 418 includes a tubular portion 430 that defines a main bearing cavity 432 in which the main bearing 82 is disposed, and the main bearing cavity 432 is in fluid communication with the drive bearing cavity 428.

The non-orbiting scroll member 416 includes a baseplate 434 and a spiral wrap (or vane) 436 extending axially from the baseplate 434 toward the orbiting scroll member 414. The spiral wrap 436 of the non-orbiting scroll member 416 cooperates with the spiral wrap 424 of the orbiting scroll member 414 to define compression pockets 438 that decrease in size as they move from a radially outer position to a radially inner position, thereby compressing the working fluid therein from the suction pressure to the discharge pressure. In addition, the non-orbiting scroll member 416 has a suction inlet 440 in fluid communication with the suction tube 28, and the baseplate 434 of the non-orbiting scroll member 416 defines a discharge passage 442 that extends axially through the baseplate 434 and allows discharge fluid to enter the discharge chamber 412.

Discharge fluid expelled through the discharge passage 442 in the non-orbiting scroll member 416 may flow radially outward and then axially past the compression mechanism 404 and the bearing housing assembly 406 to the motor assembly 408. In this regard, the non-orbiting scroll member 416 may define one or more fluid passages 444 extending axially through the non-orbiting scroll member 416, and the main bearing housing 418 may define one or more fluid passages 446 that extend axially through the main bearing housing 418 and that are radially aligned with the fluid passages 444. Thus, discharge fluid expelled through the discharge passage 442 flows through the fluid passages 444, 446 in the non-orbiting scroll member 416 and the main bearing housing 418 and to the motor assembly 408. In this regard, the discharge chamber 412 includes a first portion 448 disposed on a first side of the compression mechanism 404 and a second portion 450 disposed on a second side of the compression mechanism 404 opposite of the first side, and the fluid passages 444, 446 place the first portion 448 of the discharge chamber 412 in fluid communication with the second portion 450 of the discharge chamber 412.

The compressor 400 is similar or identical to the compressor 250 of FIG. 3 except that the orbiting scroll member 414 does not define an intermediate chamber orifice such as the intermediate chamber orifice 295. Also, in contrast to the compressor 250, there is no seal in the compressor 400, such as the annular seal 296, which prevents fluid communication between the main bearing cavity 286 and the discharge chamber 412. Instead, the main bearing housing 418 has an open end 452 similar to the main bearing housing 80 of FIG. 1, and the main bearing cavity 286 is in fluid communication with the discharge chamber 412. Further, in contrast to the main bearing housing 266 of the compressor 250, the main bearing housing 418 defines a fluid passage 454 extending radially through the tubular portion 430 of the main bearing housing 418. In addition, unlike the compressor 250, the compressor 400 includes a pair of deflectors 456 that guide discharge fluid from the discharge passage 442 to the fluid passage 454 in the main bearing housing 418. In addition, the suction tube 28 extends through an axial end surface 458 of the shell 402 instead of through an outer radial surface 460 of the shell 402. Otherwise, the structure and function of the compressor 400 is similar or identical to that of the compressor 250 described above, apart from any exceptions described below and/or shown in the figures.

The pair of deflectors 456 includes a first deflector 456-1 disposed in the first portion 448 of the discharge chamber 412 and a second deflector 456-2 disposed in the second portion 450 of the discharge chamber 412. The first deflector 456-1 guides discharge fluid from the discharge passage 442 in the non-orbiting scroll member 416 to the fluid passages 444, 446 in the non-orbiting scroll member 416 and the main bearing housing 418. Thus, the first deflector 456-1 is configured to redirect discharge fluid flowing axially in a first direction from the discharge passage 442 such that the discharge fluid flows radially outward and then axially toward the fluid passages 444, 446 in a second direction that is opposite of the first direction. In this regard, the first deflector 456-1 has an inlet 462 disposed at the discharge passage 442 and an outlet 464 disposed at and radially aligned with the fluid passages 444, 446.

The second deflector 456-2 guides discharge fluid exiting the fluid passages 444, 446 in the non-orbiting scroll member 416 and the main bearing housing 418 to the fluid passage 454 in the main bearing housing 418 and, ultimately, to the main bearing 82, the drive bearing 56, and the unloader bushing 58. Thus, lubricating fluid entrained in the discharge fluid lubricates the main bearing 82, the drive bearing 56, and the unloader bushing 58. The second deflector 456-2 is configured to redirect discharge fluid flowing axially in the second direction from the fluid passages 444, 446 such that the discharge fluid flows radially inward toward the fluid passage 454 in the main bearing housing 418. In this regard, the second deflector 456-2 has an inlet 466 that is radially aligned with the fluid passages 444, 446 and an outlet 468 that is axially aligned with the fluid passage 454. In various configurations, one or both of the first and second deflectors 456-1 and 456-2 may be omitted from the compressor 400.

With reference to FIG. 6, another high side compressor 500 is provided that includes a cylindrical shell 502, a compression mechanism 504, a bearing housing assembly 506, a motor assembly 508, and the end bearing 20. The shell 502 defines a discharge chamber 512 in which the compression mechanism 504, the bearing housing assembly 506, the motor assembly 508, and the end bearing 20 are disposed. The compression mechanism 504 includes an orbiting scroll member 514 and a non-orbiting scroll member 516, and the bearing housing assembly 506 includes a main bearing housing 518 and the main bearing 82. The main bearing housing 518 is fixed relative to the shell 502 and defines a thrust bearing surface 520 for the orbiting scroll member 514.

The orbiting scroll member 514 includes a baseplate 522, a spiral wrap (or vane) 524 extending axially from the baseplate 522, and a tubular portion 526 extending axially from the baseplate 522 in an opposite direction than the spiral wrap 524. In addition, the orbiting scroll member 514 is driven by the driveshaft 280, and the tubular portion 526 defines a drive bearing cavity 528 in which the drive bearing 56 is disposed. Further, the main bearing housing 518 includes a tubular portion 530 that defines a main bearing cavity 532 in which the main bearing 82 is disposed, and the main bearing cavity 532 is in fluid communication with the drive bearing cavity 528.

The non-orbiting scroll member 516 includes a baseplate 534 and a spiral wrap (or vane) 536 extending axially from the baseplate 534 toward the orbiting scroll member 514. The spiral wrap 536 of the non-orbiting scroll member 516 cooperates with the spiral wrap 524 of the orbiting scroll member 514 to define compression pockets 538 that decrease in size as they move from a radially outer position to a radially inner position, thereby compressing the working fluid therein from the suction pressure to the discharge pressure. In addition, the non-orbiting scroll member 516 has a suction inlet 540 in fluid communication with the suction tube 28, and the baseplate 534 of the non-orbiting scroll member 516 defines a discharge passage 542 that extends axially through the baseplate 534 and allows discharge fluid to enter the discharge chamber 512.

Discharge fluid expelled through the discharge passage 542 in the non-orbiting scroll member 516 may flow radially outward and then axially past the compression mechanism 504 and the bearing housing assembly 506 to the motor assembly 508. In this regard, the orbiting and non-orbiting scroll members 514, 516 may define fluid passages, such as the fluid passages 120, 121 of the compressor 10, which place one portion of the discharge chamber 512 disposed on a first side of the compression mechanism 504 in communication with another portion of the discharge chamber 512 disposed on a second side of the compression mechanism 504 opposite of the first side.

The orbiting scroll member 514 and the main bearing housing 518 cooperate to define an intermediate chamber 544. The drive bearing 56, the unloader bushing 58, and the main bearing 82 are located inside the intermediate chamber 544. The annular seals 296, 298 prevent fluid communication between the discharge chamber 512 and the intermediate chamber 544.

The compressor 500 is similar or identical to the compressor 250 of FIG. 3 except that the baseplate 522 of the orbiting scroll member 514 defines an intermediate chamber orifice 546 that not only extends axially through the baseplate 522, but also extends radially through the baseplate 522. The intermediate chamber orifice 546 places the compression pockets 538 in fluid communication with the intermediate chamber 544, thereby allowing working fluid at an intermediate pressure (i.e., a pressure greater than the suction pressure and less than the discharge pressure) to flow between the compression pockets 538 and the intermediate chamber 544. Lubricating fluid entrained in the intermediate fluid lubricates the drive bearing 56, the unloader bushing 58, and the main bearing 82, the Oldham coupling 70, and at least a portion of the thrust bearing surface 520. Otherwise, the structure and function of the compressor 500 is similar or identical to that of the compressor 250 described above, apart from any exceptions described below and/or shown in the figures.

The intermediate chamber orifice 546 includes a first portion 548 in fluid communication with the compression pockets 538, second and third portions 550, 552 in fluid communication with the drive bearing cavity 528, and a fourth portion 554 placing the first portion 548 in fluid communication with the second and third portions 550, 552. The first portion 548 of the intermediate chamber orifice 546 is in fluid communication with the compression pockets 538 at a location that is radially between the suction inlet 540 and the discharge passage 542. In other words, the first portion 548 extends axially through a first surface 556 of the baseplate 522 of the orbiting scroll member 514 from which the spiral wrap 524 extends, and the location at which the first portion 548 extends through the first surface 556 is radially between the suction inlet 540 and the discharge passage 542.

The second and third portions 550, 552 of the intermediate chamber orifice 546 extend axially through a second surface 558 of the baseplate 522 that is opposite of the first surface 556 of the baseplate 522. The second and third portions 550, 552 of extend axially through the second surface 558 of the baseplate 522 at locations that are radially aligned with the drive bearing cavity 528. The fourth portion 554 of the intermediate chamber orifice 546 extends radially through the baseplate 522 and extends between (i) first portion 548 of the intermediate chamber orifice 546 and (ii) the second and third portions 550, 552 of the intermediate chamber orifice 546.

The intermediate chamber orifice 546 is shown and described above as having one portion that extends axially through the first surface 556 of the baseplate 522, one portion that extends radially through the baseplate 522, and two portions that extends axially through the second surface 558 of the baseplate 522. However, in various configurations, the intermediate chamber orifice 546 may include multiple portions that extends axially through the first surface 556 of the baseplate 522 at different radial locations and/or multiple portions that extends radially through the baseplate 522 at different axial locations. Additionally or alternatively, the intermediate chamber orifice 546 may include only one portion that extends axially through the second surface 558 of the baseplate 522.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed herein could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A compressor comprising:

a shell;

a compression mechanism disposed within the shell, the compression mechanism including an orbiting scroll member and a non-orbiting scroll member, the orbiting scroll member including a baseplate and a tubular portion extending axially from the baseplate, the tubular portion defining a driveshaft cavity;

a driveshaft drivingly engaged with the orbiting scroll member, the driveshaft having a first end disposed in the driveshaft cavity of the orbiting scroll member and a second end opposite of the first end;

a drive bearing cavity disposed between an outer radial surface of the driveshaft and an inner radial surface of the tubular portion of the orbiting scroll member, the baseplate of the orbiting scroll member defining a first discharge passage in fluid communication with the drive bearing cavity;

a drive bearing disposed in the drive bearing cavity and disposed about the driveshaft adjacent to the first end of the driveshaft; and an unloader bushing disposed about the driveshaft adjacent to the first end of the driveshaft and disposed in the drive bearing cavity between the outer radial surface of the driveshaft and an inner radial surface of the drive bearing, wherein the driveshaft defines a first channel extending axially through the first end of the driveshaft and a second channel extending radially outward from the first channel and through the outer radial surface of the driveshaft, the first and second channels being configured to deliver discharge fluid from the first discharge passage to an interface between the outer radial surface of the driveshaft and an inner radial surface of the unloader bushing.

2. The compressor of claim 1 wherein the driveshaft defines a third channel extending axially from the first channel and through the second end of the driveshaft.

3. The compressor of claim 1 further comprising:

a main bearing housing fixed relative to the shell and including a second tubular portion, the second tubular portion defining a main bearing cavity in fluid communication with the drive bearing cavity; and a main bearing disposed in the main bearing cavity and disposed about the driveshaft between the first and second ends of the driveshaft, the main bearing radially supporting the driveshaft.

4. The compressor of claim 3 further comprising an end bearing disposed about the driveshaft adjacent to the second end, wherein the second tubular portion of the main bearing housing has an open end that allows discharge fluid to flow from the main bearing cavity to the end bearing.

5. The compressor of claim 1 wherein the shell defines a discharge chamber and the non-orbiting scroll member defines a second discharge passage in fluid communication with the discharge chamber.

6. The compressor of claim 1 wherein the orbiting scroll member has an axial end surface that faces the driveshaft, the first end of the driveshaft is spaced apart from the axial end surface of the orbiting scroll member to provide a clearance gap, and the clearance gap is free of any seal that prevents fluid communication between the first discharge passage in the orbiting scroll member and the drive bearing cavity.

7. A compressor comprising:

a shell;

a compression mechanism disposed within the shell, the compression mechanism including an orbiting scroll member and a non-orbiting scroll member, the orbiting scroll member including a baseplate and a tubular portion extending axially from the baseplate, the tubular portion defining a driveshaft cavity;

a driveshaft drivingly engaged with the orbiting scroll member, the driveshaft having a first end disposed in the driveshaft cavity of the orbiting scroll member and a second end opposite of the first end;

a drive bearing cavity disposed between an outer radial surface of the driveshaft and an inner radial surface of the tubular portion of the orbiting scroll member, the baseplate of the orbiting scroll member defining a first discharge passage in fluid communication with the drive bearing cavity;

a drive bearing disposed in the drive bearing cavity and disposed about the driveshaft adjacent to the first end of the driveshaft;

a main bearing housing fixed relative to the shell and including a second tubular portion, the second tubular portion defining a main bearing cavity in fluid communication with the drive bearing cavity;

a main bearing disposed in the main bearing cavity and disposed about the driveshaft between the first and second ends of the driveshaft, the main bearing radially supporting the driveshaft; and a suction tube extending through the shell, the non-orbiting scroll member defining a suction inlet in fluid communication with the suction tube, and the baseplate of the orbiting scroll member defining an intermediate chamber orifice disposed radially between the suction inlet and the first discharge passage and extending axially through the baseplate.

8. The compressor of claim 7 further comprising an unloader bushing disposed about the driveshaft adjacent to the first end of the driveshaft and disposed in the drive bearing cavity between the outer radial surface of the driveshaft and an inner radial surface of the drive bearing.

9. The compressor of claim 7 wherein the main bearing housing and the orbiting scroll member cooperate to define an intermediate chamber that is in fluid communication with the intermediate chamber orifice.

10. The compressor of claim 9 further comprising an Oldham coupling disposed in the intermediate chamber and keyed to the orbiting scroll member and the main bearing housing.

11. The compressor of claim 9 wherein the main bearing housing has a thrust bearing surface abutting the baseplate of the orbiting scroll member, the intermediate chamber placing the intermediate chamber orifice in fluid communication with at least a portion of an interface between the thrust bearing surface and the baseplate.

12. A compressor comprising:

a shell;

a compression mechanism disposed within the shell, the compression mechanism including an orbiting scroll member and a non-orbiting scroll member, the orbiting scroll member including a baseplate and a tubular portion extending axially from the baseplate, the tubular portion defining a driveshaft cavity;

a driveshaft drivingly engaged with the orbiting scroll member, the driveshaft having a first end disposed in the driveshaft cavity of the orbiting scroll member and a second end opposite of the first end;

a drive bearing cavity disposed between an outer radial surface of the driveshaft and an inner radial surface of the tubular portion of the orbiting scroll member, the baseplate of the orbiting scroll member defining a first discharge passage in fluid communication with the drive bearing cavity;

a drive bearing disposed in the drive bearing cavity and disposed about the driveshaft adjacent to the first end of the driveshaft; and a discharge valve that regulates the flow of discharge fluid from the first discharge passage to the drive bearing cavity.

13. The compressor of claim 12 wherein the discharge valve is disposed in the driveshaft cavity and axially between the orbiting scroll member and the first end of the driveshaft.

* * * * *